US011151920B2

(12) United States Patent
Hong et al.

(10) Patent No.: US 11,151,920 B2
(45) Date of Patent: Oct. 19, 2021

(54) DISPLAY DEVICE CAPABLE OF DATA OUTPUT BASED ON DEMULTIPLEXING

(71) Applicant: LG DISPLAY CO., LTD., Seoul (KR)

(72) Inventors: Yewon Hong, Seoul (KR); JungHyun Lee, Seoul (KR); TaeWoong Moon, Gyeonggi-do (KR)

(73) Assignee: LG DISPLAY CO., LTD., Seoul (KR)

( * ) Notice: Subject to any disclaimer, the term of this patent is extended or adjusted under 35 U.S.C. 154(b) by 3 days.

(21) Appl. No.: 16/504,029

(22) Filed: Jul. 5, 2019

(65) Prior Publication Data

US 2020/0184871 A1 Jun. 11, 2020

(30) Foreign Application Priority Data

Dec. 5, 2018 (KR) ..... 10-2018-0155565

(51) Int. Cl.
*G09G 3/20* (2006.01)
*G09G 3/3275* (2016.01)
*G09G 3/36* (2006.01)

(52) U.S. Cl.
CPC ..... *G09G 3/20* (2013.01); *G09G 3/3275* (2013.01); *G09G 3/3688* (2013.01); *G09G 2310/0297* (2013.01); *G09G 2310/08* (2013.01)

(58) Field of Classification Search
CPC ..... G09G 3/3696; G09G 2310/0297; G09G 2330/06; G09G 3/3648; G09G 2330/025;
(Continued)

(56) References Cited

U.S. PATENT DOCUMENTS 8,963,906 B2 2/2015 Oh
10,431,179 B2 10/2019 Hao
(Continued)

FOREIGN PATENT DOCUMENTS

CN 103106862 A 5/2013
CN 105679271 A 6/2016
(Continued)

*Primary Examiner* — Stephen G Sherman
(74) *Attorney, Agent, or Firm* — Birch, Stewart, Kolasch & Birch, LLP

(57) ABSTRACT

A demultiplexer for sequentially outputting a data signal to a plurality of data lines disposed in a display panel can include a first switch connected to a first control node, the first switch being configured to electrically connect a first channel with a first data line among the plurality of data lines; a second switch connected to a second control node, the first switch being configured to electrically connect the first channel with a second data line among the plurality of data lines; a third switch connected to a third control node, the third switch being configured to electrically connect a second channel with a third data line among the plurality of data lines; and a fourth switch connected to a fourth control node, the fourth switch being configured to electrically connect the second channel with a fourth data line among the plurality of data lines, in which the first control node and the third control node are configured to receive a single first control signal, and be electrically disconnected from each other at a point in time, the second control node and the fourth control node are configured to receive a single second control signal, and be electrically disconnected from each other at a point in time, and the first control node and the third control node have different voltage conditions than the second control node and the fourth control node.

20 Claims, 14 Drawing Sheets

(58) Field of Classification Search
CPC ..... G09G 2320/0223; G09G 3/20; G09G 3/3275; G09G 3/3688; G09G 2310/08; G06F 3/0412; G06F 3/0416; G06F 3/044; H03K 17/962; H03K 17/284
See application file for complete search history.

(56) References Cited

U.S. PATENT DOCUMENTS

| | | | | |
|---|---|---|---|---|
| 10,475,873 | B2 | 11/2019 | Matsueda et al. | |
| 10,559,274 | B2 | 2/2020 | Xi et al. | |
| 10,777,114 | B2 | 9/2020 | Moon et al. | |
| 2011/0108837 | A1* | 5/2011 | Yamazaki ..... | H01L 29/45 257/43 |
| 2016/0209808 | A1 | 7/2016 | Byun et al. | |
| 2016/0329025 | A1 | 11/2016 | Park et al. | |
| 2017/0243559 | A1 | 8/2017 | Xi et al. | |
| 2018/0190207 | A1* | 7/2018 | Hwang ..... | G09G 3/3233 |
| 2019/0362666 | A1* | 11/2019 | Chen ..... | H03K 3/037 |
| 2020/0098793 | A1* | 3/2020 | Kim ..... | G06F 3/0443 |

FOREIGN PATENT DOCUMENTS

| | | | |
|---|---|---|---|
| CN | 107016970 | A | 8/2017 |
| CN | 107689210 | A | 2/2018 |
| CN | 108694907 | A | 10/2018 |

* cited by examiner

DISPLAY DEVICE CAPABLE OF DATA OUTPUT BASED ON DEMULTIPLEXING

CROSS REFERENCE TO RELATED APPLICATION

This application claims priority to Korean Patent Application No. 10-2018-0155565, filed in the Republic of Korea on Dec. 5, 2018, which is hereby incorporated by reference for all purposes as if fully set forth herein.

BACKGROUND

Field

Example embodiments relate to a display device.

Description of Related Art

In response to the development of the information society, a range of display devices, such as an image display device, an information display device, a lighting device, and a variety of light-emitting devices, are being developed. Such a display device may include a display panel in which a plurality of data lines and a plurality of gate lines are disposed, a data driver for driving the plurality of data lines, and a gate driver for driving the plurality of gate lines.

Since there is a large number of data lines disposed in the display panel, the data driver outputting data signals to the data lines has a large number of channels.

Accordingly, a demultiplexer may be used to reduce the number of channels of the data driver. However, such a demultiplexer may experience unstable data output or abnormal data output situations, due to unexpected reasons. Such degradation in data output performance may degrade image quality.

BRIEF SUMMARY

Various aspects of the present disclosure are intended to provide demultiplexing-based data output in a reliable and appropriate manner while reducing the number of channels of the data driver by means of demultiplexing-based data output.

Example embodiments provide a resistance capacitance (RC)-reducing bootstrapping multiplexer circuit and a display device including the same.

Also provided are a bootstrapping multiplexer circuit able to reduce unnecessary capacitance and having superior charge/discharge performance, and a display device including the same.

Also provided are a bootstrapping multiplexer circuit able to improve the state of charge of subpixels, and the display device 100 including the same.

According to an aspect of the present disclosure, a display device can include a demultiplexer circuit sequentially outputting a data signal, supplied by a data driver, to a plurality of data lines disposed in a display panel.

The demultiplexer circuit can include: a first switch on-off controlled by a voltage of a first control node, and when turned on, electrically connecting a first channel and a first data line among the plurality of data lines; a second switch on-off controlled by a voltage of a second control node, and when turned on, electrically connecting the first channel and a second data line among the plurality of data lines; a third switch on-off controlled by a voltage of a third control node, and when turned on, electrically connecting a second channel and a third data line among the plurality of data lines; and a fourth switch on-off controlled by a voltage of a fourth control node, and when turned on, electrically connecting the second channel and a fourth data line among the plurality of data lines.

The first control node and the third control node can have a single first control signal applied thereto, and can be electrically disconnected from each other at a point in time. The second control node and the fourth control node can have a single second control signal applied thereto, and can be electrically disconnected from each other at a point in time.

The first control node and the third control node can have different voltage conditions from the second control node and the fourth control node.

The first and third switches can have the same on-off timing, the second and fourth switches can have the same on-off timing, and the first and third switches can have different on-off timing from the second and fourth switches.

The demultiplexer circuit can further include: a first capacitor electrically connected between a first control auxiliary node and the first control node, and a first charge/discharge control circuit controlling charge and discharge of the first capacitor; a second capacitor electrically connected between a second control auxiliary node and the second control node, and a second charge/discharge control circuit controlling charge and discharge of the second capacitor; a third capacitor electrically connected between a third control auxiliary node and the third control node, and a third charge/discharge control circuit controlling charge and discharge of the third capacitor; and a fourth capacitor electrically connected between a fourth control auxiliary node and the third control node, and a fourth charge/discharge control circuit controlling charge and discharge of the fourth capacitor.

A single first control auxiliary signal can be applied to the first and third control auxiliary nodes, and a single second control auxiliary signal can be applied to the second and fourth control auxiliary nodes.

The first and third capacitors can have the same charge and discharge timing, and the second and fourth capacitors can have the same charge and discharge timing.

The discharge of the first and third capacitors can be triggered by the charge of the second and fourth capacitors, and the discharge of the second and fourth capacitors can be triggered by the charge of the first and third capacitors.

The first charge/discharge control circuit can include a first charge controller electrically connected between a first supply node and the first control node to be on-off controlled by the first control signal, a first discharge controller electrically connected between the first supply node and the first control node to be on-off controlled by a first discharge signal, and a first discharge auxiliary controller electrically connected between the first supply node and the first control node to be on-off controlled by a first discharge auxiliary signal.

The second charge/discharge control circuit can include a second charge controller electrically connected between a second supply node and the second control node to be on-off controlled by the second control signal, a second discharge controller electrically connected between the second supply node and the second control node to be on-off controlled by a second discharge signal, and a second discharge auxiliary controller electrically connected between the second supply node and the second control node to be on-off controlled by a second discharge auxiliary signal.

The third charge/discharge control circuit can include a third charge controller electrically connected between a third supply node and the third control node to be on-off controlled by the first control signal, a third discharge controller electrically connected between the third supply node and the third control node to be on-off controlled by the first discharge signal, and a third discharge auxiliary controller electrically connected between the third supply node and the third control node to be on-off controlled by the first discharge auxiliary signal.

The fourth charge/discharge control circuit can include a fourth charge controller electrically connected between a fourth supply node and the fourth control node to be on-off controlled by the second control signal, a fourth discharge controller electrically connected between the fourth supply node and the fourth control node to be on-off controlled by the second discharge signal, and a fourth discharge auxiliary controller electrically connected between the fourth supply node and the fourth control node to be on-off controlled by the second discharge auxiliary signal.

The single first control signal can be applied to the first and third supply nodes, and the single second control signal can be applied to the second and fourth supply nodes.

The first discharge signal can be the same as the second control signal, the first discharge auxiliary signal can be the same as the second control auxiliary signal.

The second discharge signal can be the same as the first control signal, and the second discharge auxiliary signal can be the same as the first control auxiliary signal.

The rear portion of a high-level voltage period of the first control signal can overlap the front portion of a high-level voltage period of the first control auxiliary signal. The rear portion of a high-level voltage period of the second control signal can overlap the front portion of a high-level voltage period of the second control auxiliary signal.

A high-level voltage period of the first control auxiliary signal may not overlap a high-level voltage period of the second control signal. A high-level voltage period of the second control auxiliary signal may not overlap a high-level voltage period of the first control signal.

The rear portion of a high-level voltage period of the first discharge signal can overlap the front portion of a high-level voltage period of the first discharge auxiliary signal. The rear portion of a high-level voltage period of the second discharge signal can overlap the front portion of a high-level voltage period of the second discharge auxiliary signal.

At a point in time, the first and third control nodes can equally have one voltage condition from among a first voltage condition having a low-level voltage of the first control signal, a second voltage condition having a high-level voltage of the first control signal, and a third voltage condition boosted from the high-level voltage of the first control signal by a high-level voltage of the first control auxiliary signal.

At a point in time, the second and fourth control nodes can equally have one voltage condition from among a first voltage condition having a low-level voltage of the second control signal, a second voltage condition having a high-level voltage of the second control signal, and a third voltage condition boosted from the high-level voltage of the second control signal by a high-level voltage of the second control auxiliary signal.

The first to fourth switches can be oxide transistors.

The display panel can include an active area serving as an image display area and a non-active area at a periphery of the active area. The demultiplexer circuit can be disposed in the non-active area.

The non-active area can include: a pad area to which the first and second channels of the data driver are electrically connected; and a link area in which first and second data link lines are disposed, the first and second data link lines being electrically connected to the first and second channels via the pad area.

The demultiplexer circuit can electrically connect one selected from the first and second data lines, disposed in the active area, to the first data link line, and can electrically connect one selected from the third and fourth data lines, disposed in the active area, to the second data link line.

The data driver can be mounted on a circuit film electrically connected to the non-active area of the display panel.

According to embodiments, it is possible to provide demultiplexing-based data output in a reliable and appropriate manner while reducing the number of channels of the data driver by means of demultiplexing-based data output.

In addition, according to embodiments, it is possible to provide the resistance capacitance (RC)-reducing bootstrapping multiplexer circuit and the display device including the same.

In addition, according to embodiments, it is possible to provide the bootstrapping multiplexer circuit able to reduce unnecessary capacitance and having superior charge/discharge performance, and the display device including the same.

In addition, according to embodiments, it is possible to provide the bootstrapping multiplexer circuit able to improve the state of charge of subpixels, and the display device including the same.

BRIEF DESCRIPTION OF THE DRAWINGS

The above and other objects, features, and advantages of the present disclosure will be more clearly understood from the following detailed description when taken in conjunction with the accompanying drawings, in which.

DETAILED DESCRIPTION OF THE EMBODIMENTS

Figure 1:
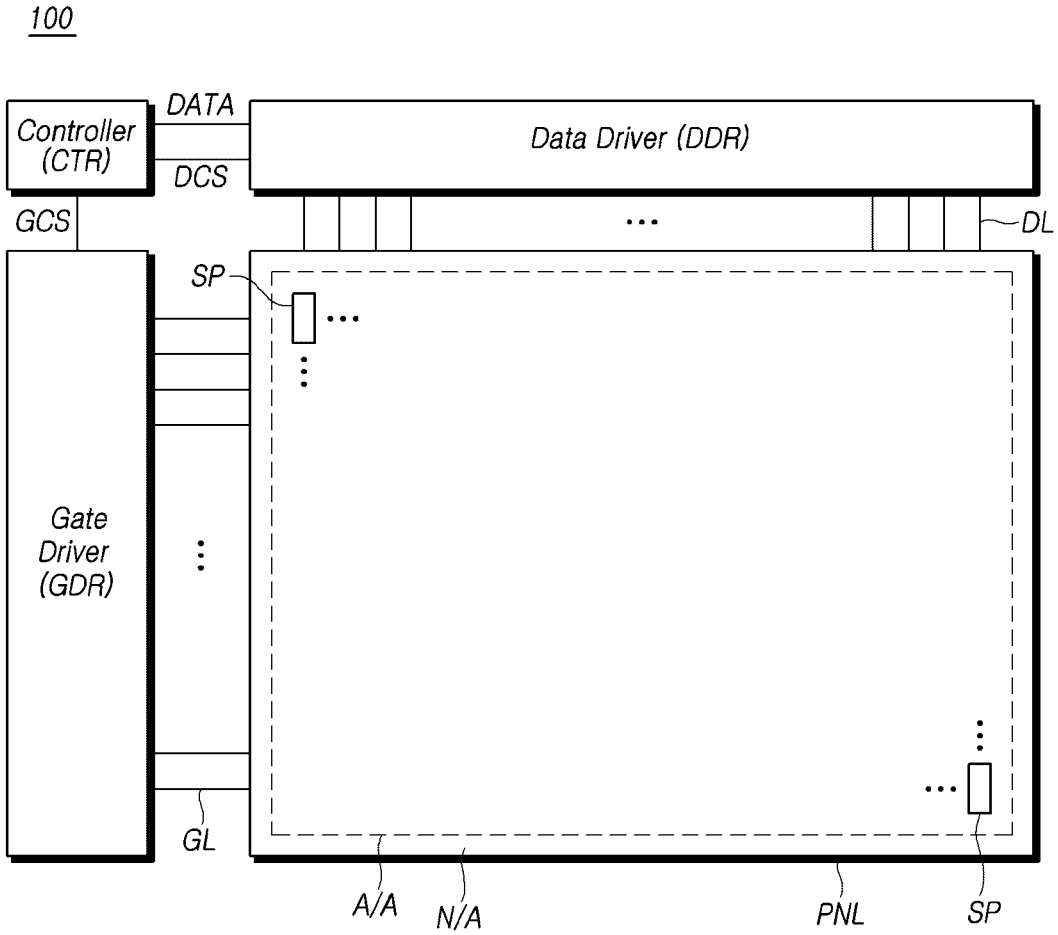
FIG. 1 illustrates a system configuration of a display device according to embodiments.

The advantages and features of the present disclosure and methods of the realization thereof will be apparent with reference to the accompanying drawings and detailed descriptions of the embodiments. The present disclosure should not be construed as being limited to the embodiments set forth herein and may be embodied in many different forms. Rather, these embodiments are provided so that the present disclosure will be thorough and complete, and will fully convey the scope of the present disclosure to a person having ordinary skill in the art. The scope of the present disclosure shall be defined by the appended Claims.

The shapes, sizes, ratios, angles, numbers, and the like, inscribed in the drawings to illustrate example embodiments are illustrative only, and the present disclosure is not limited to the embodiments illustrated in the drawings. Throughout this document, the same reference numerals and symbols will be used to designate the same or like components. In the following description of the present disclosure, detailed descriptions of known functions and components incorporated into the present disclosure will be omitted in the situation in which the subject matter of the present disclosure may be rendered unclear thereby. It will be understood that the terms "comprise," "include," "have," and any variations thereof used herein are intended to cover non-exclusive inclusions unless explicitly described to the contrary. Descriptions of components in the singular form used herein are intended to include descriptions of components in the plural form, unless explicitly described to the contrary.

In the analysis of a component, it shall be understood that an error range is included therein, even in the situation in which there is no explicit description thereof.

It will also be understood that, while terms, such as "first," "second," "A," "B," "(a)," and "(b)," may be used herein to describe various elements, such terms are merely used to distinguish one element from other elements. The substance, sequence, order, or number of such elements is not limited by these terms. It will be understood that when an element is referred to as being "connected," "coupled," or "linked" to another element, not only can it be "directly connected, coupled, or linked" to the other element, but it can also be "indirectly connected, coupled, or linked" to the other element via an "intervening" element. In the same context, it will be understood that when an element is referred to as being formed "on," "above," "under," or "next to" another element, not only can it be directly located on or under the other element, but it can also be indirectly located on or under the other element via an intervening element.

In addition, terms, such as "first" and "second" may be used herein to describe a variety of components. It should be understood, however, that these components are not limited by these terms. These terms are merely used to discriminate one element or component from other elements or components. Thus, a first element referred to as first hereinafter may be a second element within the spirit of the present disclosure.

The features (or components) of embodiments of the present disclosure can be partially or entirely coupled or combined with each other and may work in concert with each other or may operate in a variety of technical methods. In addition, respective embodiments may be carried out independently or may be associated with and carried out in concert with other embodiments.

Hereinafter, example embodiments will be described in detail with reference to the accompanying drawings.

FIG. 1 illustrates a system configuration of a display device 100 according to embodiments.

The display device 100 according to embodiments may include an image display device, an information display device, a lighting device, and a variety of light-emitting devices. The following description will mainly be focused on the image display device for the sake of brevity. However, the following description can be applied to any type of electronic device, as long as a plurality of subpixels SP are disposed in a display panel PNL and a data signal is supplied to the subpixels SP through data lines DL.

The display device 100 according to embodiments can include a display panel PNL displaying images or emitting light and driver circuits driving the display panel PNL.

In the display panel PNL, a plurality of data lines DL and a plurality of gate lines GL can be disposed, and a plurality of subpixels SP, defined by the plurality of gate lines and the plurality of data lines, can be arrayed in the form of a matrix.

In the display panel PNL, the plurality of data lines DL and the plurality of gate lines GL can be disposed to intersect each other. For example, the plurality of gate lines GL can be arrayed in rows or columns, while the plurality of data lines DL can be arrayed in columns or rows. In the following description, the plurality of gate lines GL will be regarded as being arrayed in rows, while the plurality of data lines DL will be regarded as being arrayed in columns, for the sake of brevity.

Various signal lines, other than the plurality of data lines DL and the plurality of gate lines GL, can be disposed in the display panel PNL, depending on the subpixel structure or the like. Driving voltage lines, reference voltage lines, common voltage lines, and the like can further be disposed.

The display panel PNL can be one of various types of panels, such as a liquid crystal display (LCD) panel and an organic light-emitting diode (OLED) panel.

Types of signal lines disposed in the display panel PNL can vary, depending on the subpixel structure, the panel type (e.g. an LCD panel or an OLED panel), or the like. In addition, the term "signal lines" used herein can conceptually include electrodes to which signals are applied.

The display panel PNL can include an active area A/A in which images are displayed and a non-active area N/A in which no images are displayed, the non-active area N/A being located at the periphery of the active area A/A. The non-active area N/A is also referred to as a bezel area.

The plurality of subpixels SP for displaying images are disposed in the active area A/A. Sometimes, one or more subpixels SP can be disposed, for a variety of purposes, in a portion of the non-active area N/A.

The non-active area N/A includes a pad area (or a bonding area) to which a data driver DDR is electrically connected.

The non-active area N/A can include a plurality of data link lines connecting the data driver DDR, connected to the pad area, and the plurality of data lines DL are disposed. The plurality of data link lines can be extensions of the plurality of data lines DL into the non-active area N/A or separate patterns electrically connected to the plurality of data lines DL.

In addition, gate driving-related lines can be disposed in the non-active area N/A to transfer voltages (or signals)

necessary for gate driving to a gate driver GDR via the pad area to which the data driver DDR is electrically connected.

For example, the gate driving-related lines can include clock lines, through which clock signals are transferred, gate voltage lines, through which gate voltages VGH and VGL are transferred, gate driving control signal lines, through which a variety of control signals necessary for the generation of a scanning signal are transferred, and the like. These gate driving-related lines are disposed in the non-active area N/A, unlike the gate lines GL disposed in the active area A/A.

The driver circuits can include the data driver DDR driving the plurality of data lines DL, the gate driver GDR driving the plurality of gate lines GL, a controller CTR controlling the data driver DDR and the gate driver GDR, and the like.

The data driver DDR can drive the plurality of data lines DL by outputting a data signal (or data voltage) to the plurality of data lines DL.

The gate driver GDR can drive the plurality of gate lines GL by outputting a scanning signal to the plurality of gate lines GL.

The controller CTR can control the driving operations, as well as the driving timing, of the data driver DDR and the gate driver GDR by supplying a variety of control signals DCS and GCS necessary for the driving operations of the data driver DDR and the gate driver GDR. In addition, the controller CTR can supply digital image data DATA to the data driver DDR.

The controller CTR starts scanning at points in time realized by respective frames, converts data input from an external source into image data DATA having a data signal format readable by the data driver DDR, outputs the image data DATA, and controls data driving at appropriate points in time, according to the scanning.

The controller CTR receives timing signals, including a vertical synchronization signal Vsync, a horizontal synchronization signal Hsync, an input data enable signal DE, a clock signal CLK, and the like, from an external source (e.g. a host system), generates a variety of control signals, and outputs the variety of control signals to the data driver DDR and the gate driver GDR in order to control the data driver DDR and the gate driver GDR.

For example, the controller CTR outputs a variety of gate control signals GCS, including a gate start pulse (GSP), a gate shift clock (GSC), a gate output enable (GOE) signal, and the like, to control the gate driver GDR.

In addition, the controller CTR outputs a variety of data control signals DCS, including a source start pulse (SSP), a source sampling clock (SSC), a source output enable (SOE) signal, and the like, to control the data driver DDR.

The controller CTR can be a timing controller used in a typical display device, or can be a control device including a timing controller and performing other control functions.

The controller CTR can be provided as a component separate from the data driver DDR, or can be provided as an integrated circuit (IC) combined (or integrated) with the data driver DDR.

The data driver DDR receives digital image data DATA from the controller CTR and supplies an analog data signal to the plurality of data lines DL to drive the plurality of data lines DL. The data driver DDR is also referred to as a source driver.

The data driver DDR can send and receive a variety of signals to and from the controller CTR via a variety of interfaces.

The gate driver GDR sequentially drives the plurality of gate lines GL by sequentially supplying a scanning signal to the plurality of gate lines GL. The gate driver GDR is also referred to as a scan driver.

The gate driver GDR sequentially supplies the scanning signal having an on or off voltage to the plurality of gate lines GL, under the control of the controller CTR.

If a specific gate line is opened by the gate driver GDR, the data driver DDR converts the image data DATA, received from the controller CTR, into an analog data signal, and supplies the data signal to the plurality of data lines DL.

The data driver DDR can be disposed on one side of the panel PNL (e.g. above or below or to the right or left of the panel PNL). In some situations, the data driver DDR can be disposed on both sides of the panel PNL (e.g. above and below or to the right and left of the panel PNL), depending on the driving system, the design of the panel, or the like.

The gate driver GDR can be disposed on one side of the panel PNL (e.g. to the right or left of or above or below the panel PNL). In some situations, the gate driver GDR can be disposed on both sides of the panel PNL (e.g. to the right and left of or above and below the panel PNL), depending on the driving system, the design of the panel, or the like.

The data driver DDR can include one or more source driver ICs (SDICs).

Each of the source driver ICs can include a shift register, a latch circuit, a digital-to-analog converter (DAC), an output buffer, and the like. In some situations, the data driver DDR can further include one or more analog-to-digital converters (ADCs).

Each of the source driver ICs can be connected to a bonding pad of the display panel PNL by a tape-automated bonding (TAB) method or a chip-on-glass (COG) method, or can be directly mounted on the display panel PNL. In some situations, each of the source driver ICs can be integrated with the display panel PNL. In addition, each of the source driver ICs can be implemented using a chip-on-film (COF) structure. In this situation, each of the source driver ICs can be mounted on a circuit film to be electrically connected to the data lines DL in the display panel PNL via the circuit film.

The gate driver GDR can include a plurality of gate driver circuits (GDCs). The plurality of gate driver circuits can correspond to the plurality of gate lines GL, respectively.

Each of the gate driver circuits can include a shift register, a level register, and the like.

Each of the gate driver circuits can be connected to a bonding pad of the display panel PNL by a TAB method or a COG method. In addition, each of the gate driver circuits can be implemented using a COF structure. In this situation, each of the gate driver circuits can be mounted on a circuit film to be electrically connected to the gate lines GL in the display panel PNL via the circuit film. In addition, each of the gate driver circuits can be implemented using gate-in-panel (GIP) structure disposed within the display panel PNL. That is, each of the gate driver circuits can be directly provided in the display panel PNL.

Figure 2:
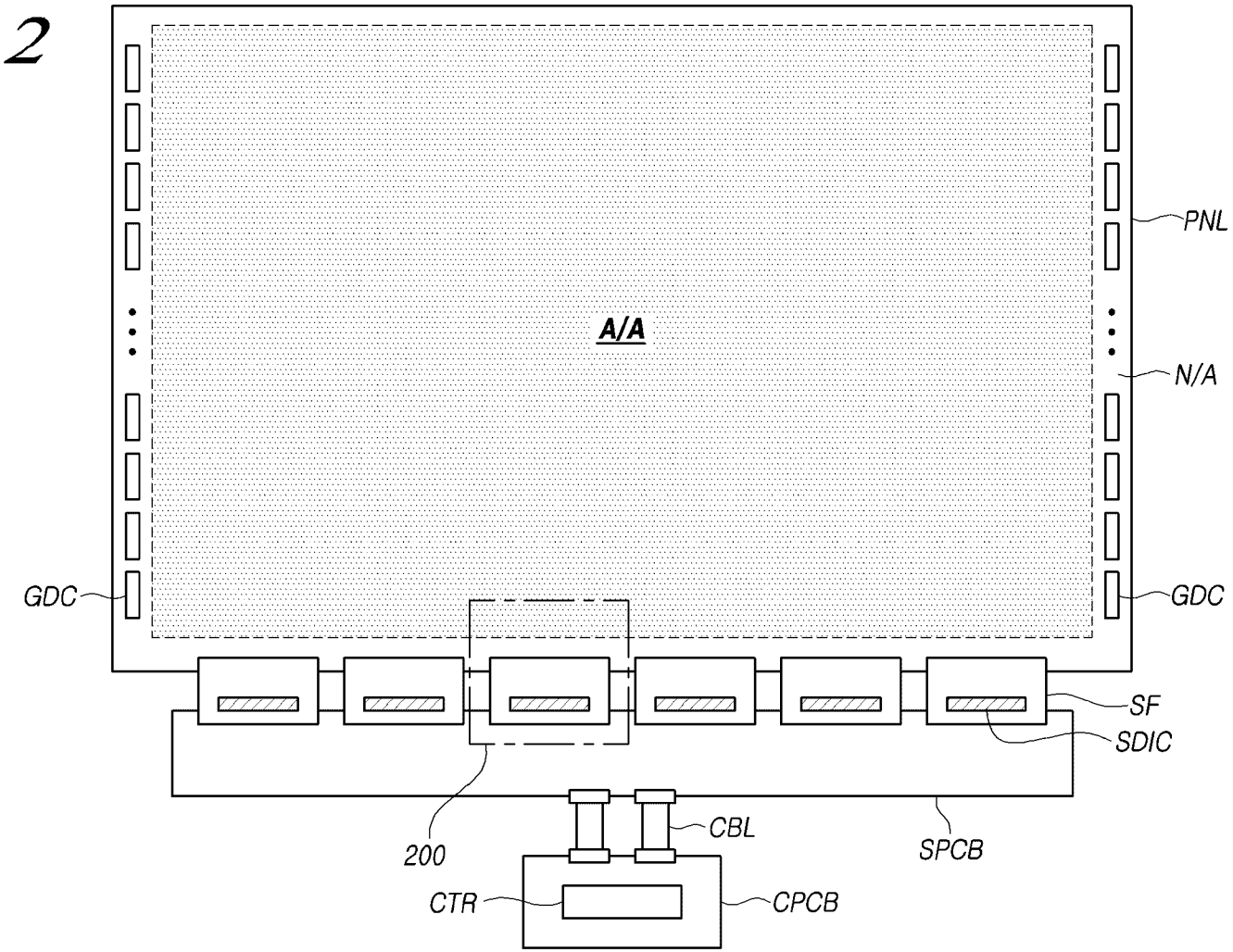
FIG. 2 illustrates an example system of the display device according to embodiments.

FIG. 2 illustrates an exemplary system of the display device according 100 to embodiments.

FIG. 2 is a diagram illustrating the display device 100 in a situation in which the data driver DDR is implemented using a COF structure among a plurality of structures, such as a TAB structure, a COG structure, and a COF structure, and the gate driver GDR is implemented using a GIP structure among a variety of structures, such as a TAB structure, a COG structure, a COF structure, and a GIP structure.

The data driver DDR can be comprised of one source driver IC. FIG. 2 illustrates a situation in which the data driver DDR is comprised of a plurality source driver ICs SDIC.

In a situation in which the data driver DDR has the COF structure, each of the source driver ICs SDIC of the data driver DDR can be mounted on a circuit film SF.

One portion of each of the circuit films SF can be electrically connected to a corresponding pad among a plurality of pads in the pad area present in the non-active area N/A of the display panel PNL.

Lines, electrically connecting the source driver ICs SDIC and the display panel PNL, can be disposed on the circuit films SF.

The display device 100 can include at least one source printed circuit board SPCB and a control printed circuit board CPCB, on which control components and a variety of electric devices are mounted, in order to connect the plurality of source driver ICs SDIC to the circuits of the other devices.

The other portion of each of the circuit films SF, on which the source driver ICs SDIC are mounted, can be connected to the at least one source printed circuit board SPCB.

That is, one portion of each of the circuit films SF, on which the source driver ICs SDIC are mounted, can be electrically connected to the pad area in the non-active area N/A of the display panel PNL, while the other portion of each of the source-side circuit films SF can be electrically connected to the source printed circuit board SPCB.

The controller CTR, controlling the operation of the data driver DDR, the gate driver GDR, and the like, can be disposed in the control printed circuit board CPCB.

In addition, a power management IC (PMIC) or the like can be disposed on the control printed circuit board CPCB. The power management IC supplies various forms of voltage or current to the display panel PNL, the data driver DDR, the gate driver GDR, and the like, or controls various forms of voltage or current to be supplied to the same.

The circuit of the source printed circuit board SPCB and the circuit of the control printed circuit board CPCB can be connected by at least one connector CBL. The connector CBL can be, for example, a flexible printed circuit (FPC), a flexible flat cable (FFC), or the like.

The at least one source printed circuit board SPCB and the control printed circuit board CPCB can be integrated (or combined) into a single printed circuit board.

In a situation in which the gate driver GDR is implemented using a GIP structure, the gate driver GDR can include a plurality of gate driver circuits GDC directly disposed in the non-active area N/A of the display panel PNL.

Each of the plurality of gate driver circuits GDC can output a scanning signal SCAN to a corresponding gate line GL among the plurality of gate lines GL disposed in the active area A/A of the display panel PNL.

The plurality of gate driver circuits GDC disposed on the display panel PNL can be supplied with a variety of signals (e.g., a clock signal, a high-level gate voltage VGH, a low-level gate voltage VGL, a start signal VST, a reset signal RST, and the like), necessary for the generation of the scanning signal, via the gate driving-related lines disposed in the non-active area N/A.

The gate driving-related lines disposed in the non-active area N/A can be electrically connected to certain circuit films SF disposed closest to the plurality of gate driver circuits GDC.

Hereinafter, an area 200 in which one source driver IC SDIC, among the plurality of source driver ICs SDIC, is connected to the display panel PNL using a COF structure will be described in more detail with reference to FIG. 3.

Figure 3:
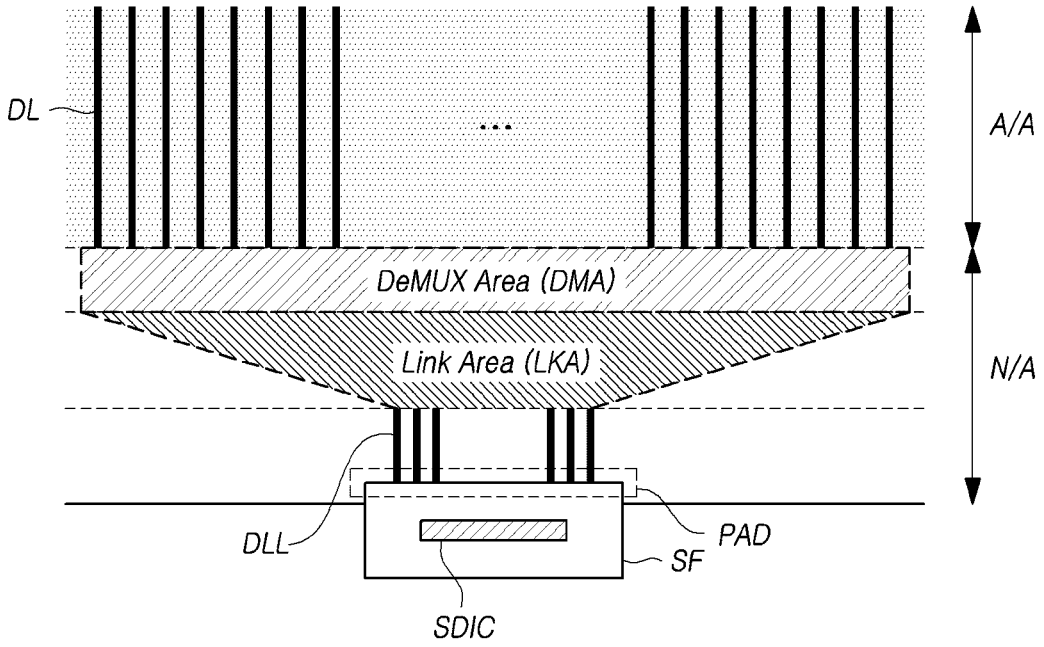
FIG. 3 illustrates an area in which the source driver IC having a COF structure, included in the data driver of the display device according to embodiments, is connected to the display panel.

FIG. 3 illustrates the area 200 in which the source driver IC SDIC having a chip-on-film (COF) structure, included in the data driver DDR of the display device 100 according to embodiments, is connected to the display panel PNL.

Referring to FIG. 3, the display panel PNL can include an active area A/A, e.g., an image display area, and a non-active area N/A at the periphery of the active area A/A.

The non-active area N/A can include a pad area PAD to which the data driver DDR having a COF structure is electrically connected.

A plurality of pads can be disposed in the pad area PAD of the non-active area N/A, a circuit film SF can be electrically connected to the plurality of pads.

The source driver IC SDIC of the data driver DDR is mounted on the circuit film SF.

Signal lines electrically connecting the plurality of pads, disposed in the pad area PAD of the non-active area N/A, to pins of the source driver IC SDIC can be disposed on the circuit film SF. The pins of the source driver IC SDIC correspond to channels through which a data signal is output.

The non-active area N/A can include a link area LKA in which a plurality of data link lines DLL are disposed.

The plurality of data link lines DLL, disposed in the link area LKA, can be electrically connected to the channels (e.g., pins) of the source driver IC SDIC via the pad area PAD of the non-active area N/A. The number of the channels (e.g., pins) of the source driver IC SDIC can be the same as the number of the plurality of data link lines DLL.

In addition, the plurality of data link lines DLL, disposed in the link area LKA of the non-active area N/A, can be electrically connected to the plurality data lines DL disposed in the active area A/A.

The number of the plurality of data link lines DLL, disposed in the link area LKA of the non-active area N/A, can be the same as the number of the plurality data lines DL disposed in the active area A/A.

Alternatively, the number of the plurality of data link lines DLL, disposed in the link area LKA of the non-active area N/A, can be smaller than the number of the plurality data lines DL disposed in the active area A/A.

In this situation, at a point in time, the plurality of data link lines DLL, disposed in the link area LKA of the non-active area N/A, can be selectively connected to a portion of the plurality of data lines DL disposed in the active area A/A. In addition, at another point in time, the plurality of data link lines DLL, disposed in the link area LKA of the non-active area N/A, can be selectively connected to another portion of the plurality of data lines DL disposed in the active area A/A.

In this regard, the plurality of data link lines DLL, disposed in the link area LKA of the non-active area N/A, and the plurality of data lines DL, disposed in the active area A/A, can be connected via a demultiplexer circuit DeMUX. The demultiplexer circuit DeMUX is also referred to as a data distribution circuit.

In other words, in the point of view of a single data link line DLL, the demultiplexer circuit DeMUX can electrically connect one data line selected from two or more data lines, disposed in the active area A/A, to the single data link line DLL.

Accordingly, data signals supplied by the source driver IC SDIC are supplied to the plurality of data link lines DLL disposed in the link area LKA of the non-active area N/A. In addition, the demultiplexer circuit DeMUX can select a data line group (e.g., an odd-numbered data line group) from among the plurality of data lines DL disposed in the active area A/A and electrically connect the selected data line group to the plurality of data link lines DLL, so that data signals are output to the selected data line group (e.g., odd-numbered data line group) among the plurality of data lines DL.

Afterwards, other data signals supplied by the source driver IC SDIC are supplied to the plurality of data link lines DLL, disposed in the link area LKA of the non-active area N/A. In addition, the demultiplexer circuit DeMUX can select another data line group (e.g., an even-numbered data line group) from among the plurality of data lines DL disposed in the active area A/A and electrically connect the selected data line group to the plurality of data link lines DLL, so that data signals are output to the selected data line group (e.g. even-numbered data line group) among the plurality of data lines DL.

The selected data line group (e.g. odd-numbered data line group) and the other selected data line group (e.g., even-numbered data line group) can be driven by time division in one horizontal time 1H.

As described above, the use of the demultiplexer circuit DeMUX in data output can advantageously reduce the number of pins (e.g., channels) of the source driver IC SDIC.

The demultiplexer circuit DeMUX can be disposed in a demultiplexer circuit area DMA allocated in the non-active area N/A.

For example, during a first period, a data signal, output from a first channel of the source driver IC SDIC, is supplied to a first data link line DLL. The data signal, supplied to the first data link line DLL, can be output to a first data line DL selected by the demultiplexer circuit DeMUX. In this situation, for example, if there are first and second data lines DL connectable to the first data link line DLL, the first data line DL, selected by the demultiplexer circuit DeMUX, is selected from the first and second data lines DL connectable to the first data link line DLL.

Afterwards, during a second period, a data signal, output from the first channel of the source driver IC SDIC, is supplied to the first data link line DLL. The data signal, supplied to the first data link line DLL, can be output to a second data line DL selected by the demultiplexer circuit DeMUX. In this situation, for example, if there are first and second data lines DL connectable to the first data link line DLL, the second data line DL, selected by the demultiplexer circuit DeMUX, is selected from the first and second data lines DL connectable to the first data link line DLL. In addition, the first period and the second period are included in the first horizontal time 1H.

Figure 4:
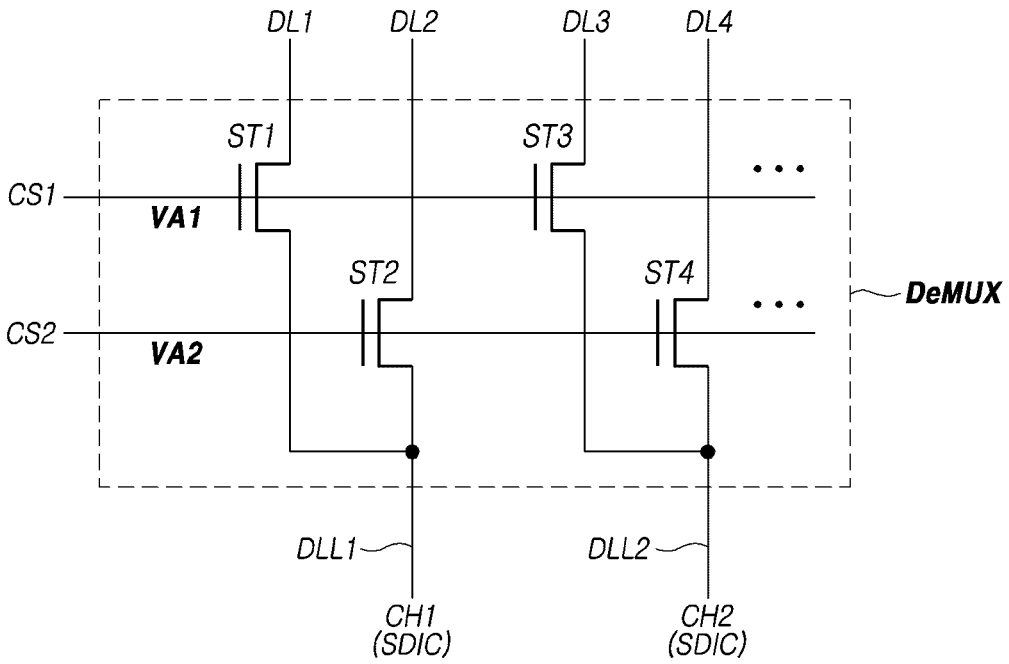
FIG. 4 is a diagram illustrating a demultiplexer circuit according to embodiments.
Figure 5:
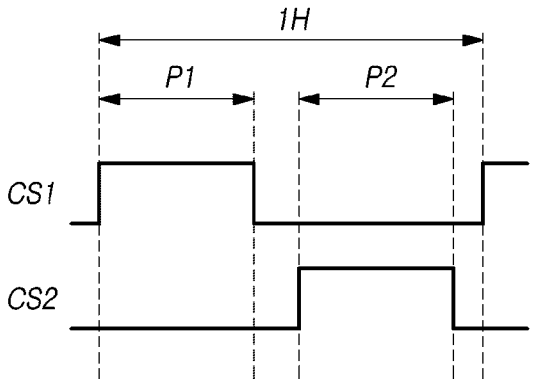
FIG. 5 is a driving timing diagram of the demultiplexer circuit illustrated in FIG. 4 according to embodiments.

FIG. 4 is a diagram illustrating a demultiplexer circuit DeMUX related to data output in the display device 100 according to embodiments, FIG. 5 is a driving timing diagram of the demultiplexer circuit DeMUX illustrated in FIG. 4.

Hereinafter, for the sake of brevity, the demultiplexer circuit DeMUX will be regarded as performing 1:2 demultiplexing.

A Sequential supply of a data signal, output from a first channel CH1 of the source driver IC SDIC to a first data link line DLL1, to two data lines DL1 and DL2 by the demultiplexer circuit DeMUX, and a sequential supply of a data signal, output from a second channel CH2 of the source driver IC SDIC to a second data link line DLL2, to two data lines DL3 and DL4 by the demultiplexer circuit DeMUX will be described by way of example.

Referring to FIG. 4, the first channel CH1 of the source driver IC SDIC is electrically connected to the first data link line DLL1 disposed in the link area LKA of the non-active area N/A of the display panel PNL.

The second channel CH2 of the source driver IC SDIC is electrically connected to the second data link line DLL2 disposed in the link area LKA of the non-active area N/A of the display panel PNL.

Referring to FIG. 4, the demultiplexer circuit DeMUX can include: a first switch ST1 electrically connecting the first data link line DLL1 and a first data line DL1; a second switch ST2 electrically connecting the first data link line DLL1 and a second data line DL2; a third switch ST3 electrically connecting the second data link line DLL2 and a third data line DL3; and a fourth switch ST4 electrically connecting the second data link line DLL2 and a fourth data line DL4.

The first switch ST1 can be a transistor having a drain node or a source node electrically connected to the first channel CH1 of the source driver IC SDIC, the source node or the drain node electrically connected to the first data line DL1, and a gate node.

The second switch ST2 can be a transistor having a drain node or a source node electrically connected to the first channel CH1 of the source driver IC SDIC, the source node or the drain node electrically connected to the second data line DL2, and a gate node.

The third switch ST3 can be a transistor having a drain node or a source node electrically connected to the second channel CH2 of the source driver IC SDIC, the source node or the drain node electrically connected to the third data line DL3, and a gate node.

The fourth switch ST4 can be a transistor having a drain node or a source node electrically connected to the second channel CH2 of the source driver IC SDIC, the source node or the drain node electrically connected to the fourth data line DL4, and a gate node.

The gate node of the first switch ST1 and the gate node of the third switch ST3 are electrically connected, and correspond to a first control node VA1. The first control node VA1 is also referred to as a first control line, to which a first control signal CS1 is applied.

The gate node of the second switch ST2 and the gate node of the fourth switch ST4 are electrically connected, and correspond to a second control node VA2. The second control node VA2 is also referred to as a second control line, to which a second control signal CS2 is applied.

The first control node VA1 and the second control node VA2 are also referred to as bootstrapping nodes.

The first switch ST1 and the third switch ST3 are on-off controlled by a single first control signal CS1 applied to the same first control node VA1.

The second switch ST2 and the fourth switch ST4 are on-off controlled by a single second control signal CS2 applied to the same second control node VA2.

Referring to FIG. 5, the first and third switches ST1 and ST3 can be turned on during a first period P1, while the second and fourth switches ST2 and ST4 can be turned on during a second period P2, different from the first period P1. The first period P1 and the second period P2 can be included in a predetermined time (e.g., a single horizontal time 1H).

Referring to FIG. 5, during the first period P1 in the single horizontal time 1H, the first switch ST1 and the third switch ST3 are in a turned-on state, while the second switch ST2 and the fourth switch ST4 are in a turned-off state.

During the first period P1, a first data signal, output from the first channel CH1 to the first data link line DLL1, is output to the first data line DL1 by the first switch ST1.

During the first period P1, a third data signal, output from the second channel CH2 to the second data link line DLL2, is output to the third data line DL3 by the third switch ST3.

Referring to FIG. 5, during the second period P2 after the first period P1 in the single horizontal time 1H, the second switch ST2 and the fourth switch ST4 are in the turned-on state, while the first switch ST1 and the third switch ST3 are in the turned-off state.

During the second period P2, a second data signal, output from the first channel CH1 to the first data link line DLL1, is output to the second data line DL2 by the second switch ST2.

During the second period P2, a fourth data signal, output from the second channel CH2 to the second data link line DLL2, is output to the fourth data line DL4 by the fourth switch ST4.

In addition, the first to fourth switches ST1, ST2, ST3, and ST4 in the demultiplexer circuit DeMUX can be implemented as various types of transistors.

For example, the first to fourth switches ST1, ST2, ST3, and ST4 in the demultiplexer circuit DeMUX can be formed of one selected from among, but not limited to, amorphous silicon thin-film transistor (a-Si TFT), low-temperature polycrystalline silicon (LTPS) TFT, and oxide TFT.

In this regard, the a-Si TFT does not have superior electrical properties (or performance), such as electron mobility, while the LTPS TFT has superior electron mobility. However, the LTPS TFT additionally uses complex processing, including a high-temperature heat treatment and a fine mask treatment. Consequently, the fabrication costs can be expensive and uniformity may not be high, which are problematic. Thus, the oxide TFT can be applied, due to the superior uniformity and reasonable fabrication costs thereof. However, the oxide TFT has lower electron mobility and tends to be deteriorated, compared to the LTPS TFT.

Nevertheless, due to the merits of the oxide TFT, the first to fourth switches ST1, ST2, ST3, and ST4 in the demultiplexer circuit DeMUX, disposed in the non-active area N/A of the display panel PNL, can be formed of the oxide TFT.

Accordingly, embodiments propose a bootstrapping demultiplexer circuit BTS_DeMUX as a novel demultiplexer circuit DeMUX able to improve data output efficiency (or a response rate), even in the situation that the first to fourth switches ST1, ST2, ST3, and ST4 are formed of an oxide TFT.

Hereinafter, the bootstrapping demultiplexer circuit BTS_DeMUX for improving data output efficiency, according to embodiments, will be described.

Figure 6:
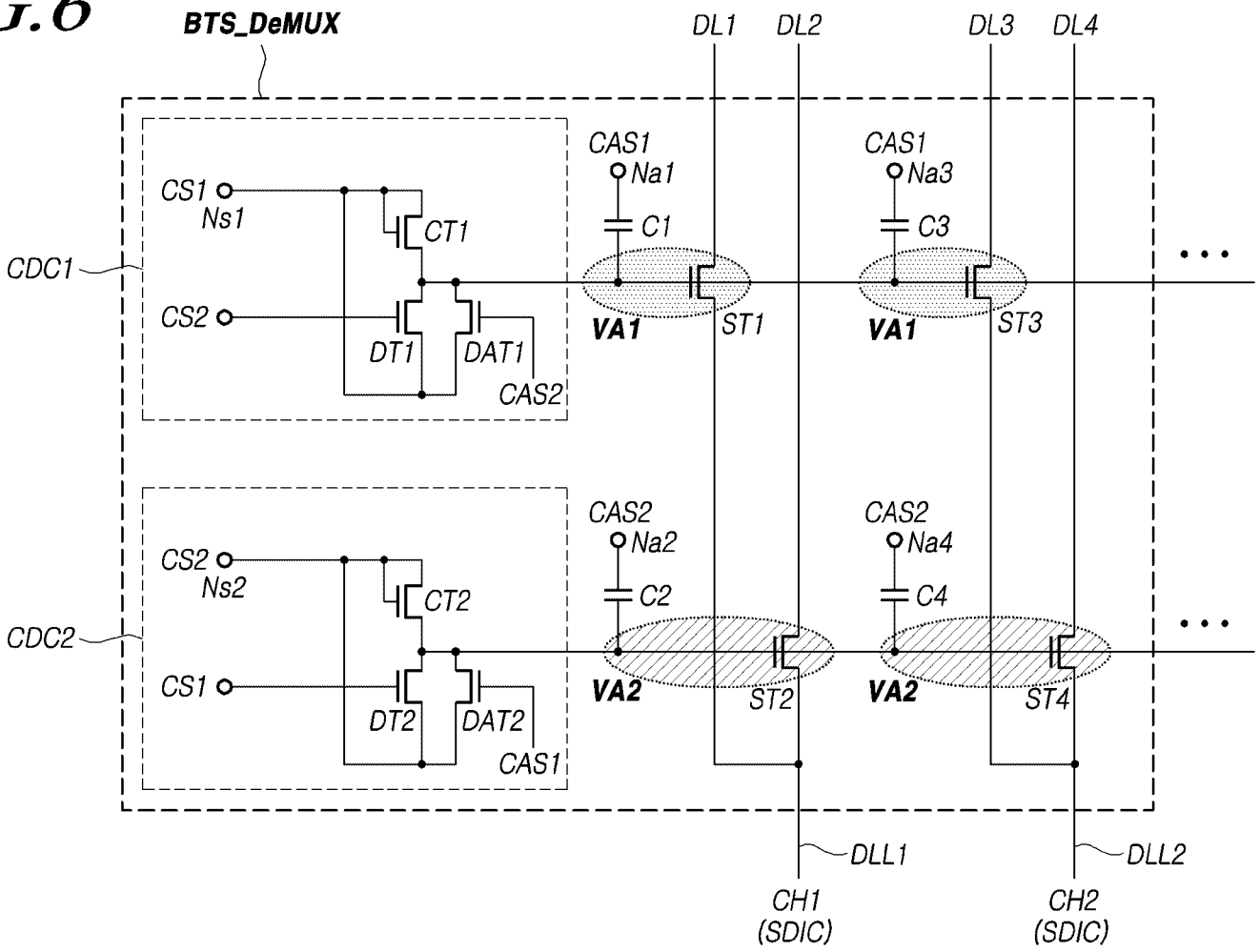
FIG. 6 illustrates a bootstrapping demultiplexer circuit according to embodiments.
Figure 7:
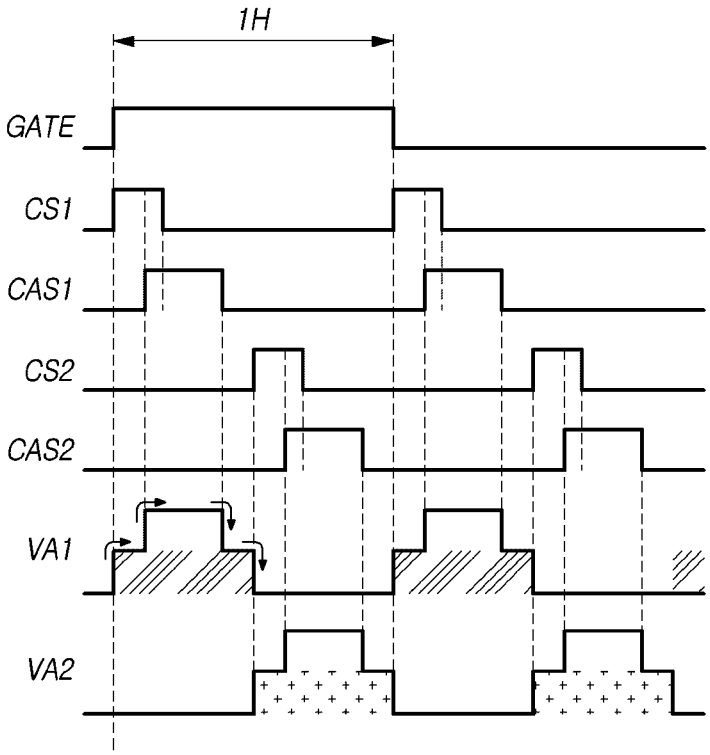
FIG. 7 is a driving timing diagram of the bootstrapping demultiplexer circuit illustrated in FIG. 6 according to embodiments.
Figure 8:
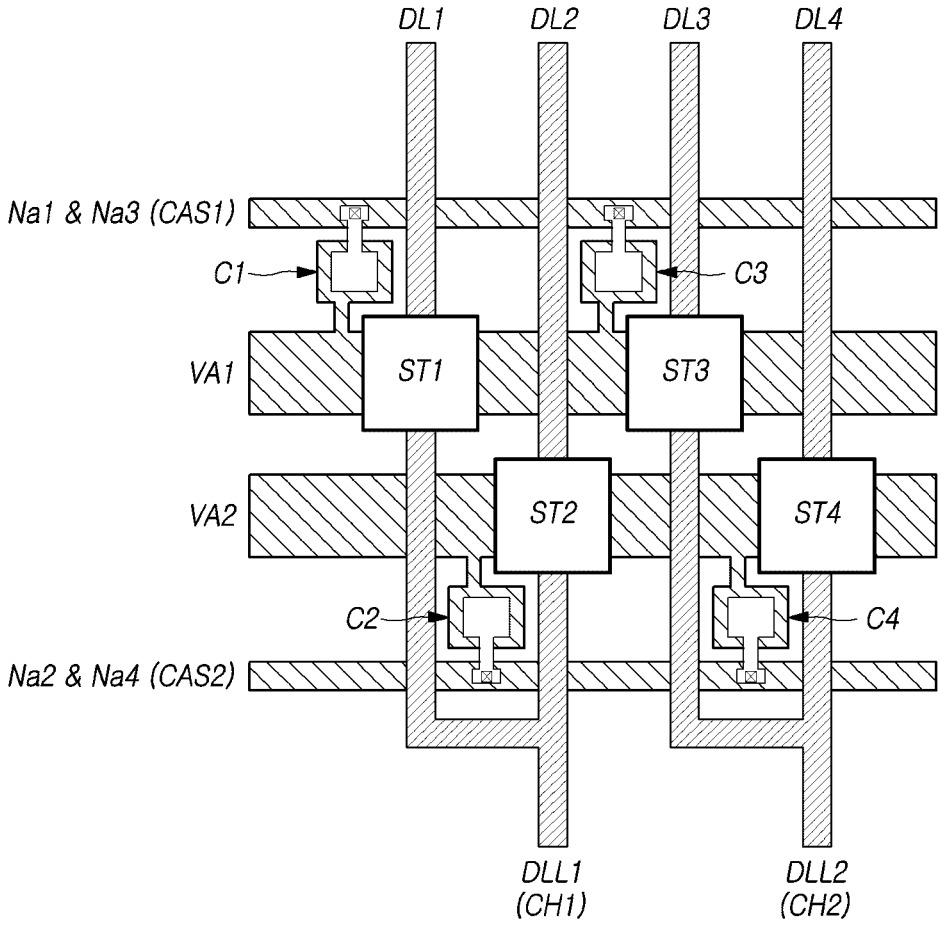
FIG. 8 is a plan view of an area of the bootstrapping demultiplexer circuit according to embodiments, in which the first to fourth switches are fabricated.

FIG. 6 illustrates the bootstrapping demultiplexer circuit BTS_DeMUX according to embodiments. FIG. 7 is a driving timing diagram of the bootstrapping demultiplexer circuit BTS_DeMUX illustrated in FIG. 6. FIG. 8 is a plan view of an area of the bootstrapping demultiplexer circuit BTS_DeMUX according to embodiments, in which the first to fourth switches ST1, ST2, ST3, and ST4 are fabricated.

Referring to FIG. 6, the bootstrapping demultiplexer circuit BTS_DeMUX according to embodiments is a circuit sequentially outputting a data signal, supplied by the data driver DDR, to the plurality of data lines DL disposed in the display panel PNL.

Referring to FIG. 6, the bootstrapping demultiplexer circuit BTS_DeMUX can include the first switch ST1, the second switch ST2, the third switch ST3, the fourth switch ST4, and the like.

The first switch ST1 can be on-off controlled by the voltage of the gate node, and when turned on, electrically connect the first channel CH1 and the first data line DL1.

The second switch ST2 can be on-off controlled by the voltage of the gate node, and when turned on, electrically connect the first channel CH1 and the second data line DL2.

The third switch ST3 can be on-off controlled by the voltage of the gate node, and when turned on, electrically connect the second channel CH2 and the third data line DL3.

The fourth switch ST4 can be on-off controlled by the voltage of the gate node, and when turned on, electrically connect the second channel CH2 and the fourth data line DL4.

Referring to FIG. 6, a single first control signal CS1 can be applied to the gate node of the first switch ST1 and the gate node of the third switch ST3. The gate node of the first switch ST1 and the gate node of the third switch ST3 can be electrically connected to each other. In this regard, the gate node of the first switch ST1 and the gate node of the third switch ST3 can be electrodes or lines contacted or integrated by a connecting pattern.

Accordingly, the gate node of the first switch ST1 and the gate node of the third switch ST3 form the first control node VA1. The first control signal CS1, applied to the first control node VA1, can have a high-level voltage or a low-level voltage.

Referring to FIG. 6, a single second control signal CS2 can be applied to the gate node of the second switch ST2 and the gate node of the fourth switch ST4. The gate node of the second switch ST2 and the gate node of the fourth switch ST4 can be electrically connected to each other. In this regard, the gate node of the second switch ST2 and the gate node of the fourth switch ST4 can be electrodes or lines contacted or integrated by a connecting pattern.

Accordingly, the gate node of the second switch ST2 and the gate node of the fourth switch ST4 can form the single second control node VA2. The second control signal CS2, applied to the second control node VA2, can have a high-level voltage or a low-level voltage.

Referring to FIGS. 6 and 7, the first control node VA1 and the second control node VA2 have different voltage conditions.

Since the gate node of the first switch ST1 and the gate node of the third switch ST3 are electrically connected, the gate node of the first switch ST1 and the gate node of the third switch ST3 have the same voltage condition (e.g., the gates of ST1 can ST3 can be tied to each other). Accordingly, the first switch ST1 and the third switch ST3 have the same on-off timing, depending on the voltage of the first control node VA1 (e.g., since their gates are tied, they turn on and off at the same time).

Since the gate node of the second switch ST2 and the gate node of the fourth switch ST4 are electrically connected to each other, the gate node of the second switch ST2 and the gate node of the fourth switch ST4 have the same voltage condition. Accordingly, the second switch ST2 and the fourth switch ST4 have the same on-off timing (e.g., since their gates are tied, they turn on and off at the same time), depending on the voltage of the second control node VA2.

The voltage (or a change in the voltage) of the first control node VA1 differs from the voltage (or a change in the voltage) of the second control node VA2. That is, the first switch ST1 and the third switch ST3, controlled depending on the voltage of the first control node VA1, have different on-off timing from the second switch ST2 and the fourth switch ST4 controlled by the voltage of the second control node VA2.

Referring to FIG. 6, the bootstrapping demultiplexer circuit BTS_DeMUX can include:

a first capacitor C1 electrically connected between a first control auxiliary node Na1 and the first control node VA1 corresponding to the gate node of the first switch ST1;

a second capacitor C2 electrically connected between a second control auxiliary node Nat and the second control node VA2 corresponding to the gate node of the second switch ST2;

a third capacitor C3 electrically connected between a third control auxiliary node Na3 and the first control node VA1 corresponding to the gate node of the third switch ST3;

and a fourth capacitor C4 electrically connected between a fourth control auxiliary node Na4 and the second control node VA2 corresponding to the gate node of the fourth switch ST4.

Referring to FIG. 6, the bootstrapping demultiplexer circuit BTS_DeMUX can further include: a first charge/discharge control circuit CDC1 controlling the charge and discharge of the first capacitor C1 and the third capacitor C3; and a second charge/discharge control circuit CDC2 controlling the charge and discharge of the second capacitor C2 and the fourth capacitor C4.

A single first control auxiliary signal CAS1 can be applied to the first control auxiliary node Na1 and the third control auxiliary node Na3 (e.g., Na1 and Na3 can both receive CAS1).

The first control auxiliary node Na1 and the third control auxiliary node Na3 can be electrically connected, and in this regard, can be electrodes or lines contacted or integrated by a connecting pattern (e.g., Na1 and Na3 can be tied to each other).

A single second control auxiliary signal CAS2 can be applied to the second control auxiliary node Na2 and the fourth control auxiliary node Na4 (e.g., Na2 and Na4 can both receive CAS2).

The second control auxiliary node Na2 and the fourth control auxiliary node Na4 can be electrically connected, and in this regard, can be electrodes or lines contacted or integrated by a connecting pattern (e.g., Na2 and Na4 can be tied to each other).

The first capacitor C1 and the third capacitor C3 have the same charge and discharge times, due to the same nodes (e.g., first control node VA1 and first control auxiliary node Na1) on both ends.

The second capacitor C2 and the fourth capacitor C4 have the same charge and discharge times, due to the same nodes (e.g., second control node VA2 and second control auxiliary node Na2) on both ends.

Referring to FIG. 7, the charge of the first capacitor C1 and the third capacitor C3 is triggered by a high-level voltage of the first control signal CS1. Here, a change in the voltage of the first control node VA1 from a low-level voltage to a high-level voltage corresponds to the start of the charge of the first capacitor C1 and the third capacitor C3.

In addition, the charge of the second capacitor C2 and the fourth capacitor C4 is triggered by a high-level voltage of the second control signal CS2. Here, a change in the voltage of the second control node VA2 from a low-level voltage to a high-level voltage corresponds to the start of the charge of the second capacitor C2 and the fourth capacitor C4.

Referring to FIG. 7, the discharge of the first capacitor C1 and the third capacitor C3 is triggered by the high-level voltage of the second control signal CS2. Here, a change in the voltage of the first control node VA1 from a high-level voltage to a low-level voltage corresponds to the start of the discharge of the first capacitor C1 and the third capacitor C3.

Accordingly, the discharge of the first capacitor C1 and the third capacitor C3 can be triggered by the charge of the second capacitor C2 and the fourth capacitor C4. The discharge of the first capacitor C1 and the third capacitor C3 can correspond to the charge of the second capacitor C2 and the fourth capacitor C4.

In addition, the discharge of the second capacitor C2 and the fourth capacitor C4 is triggered by the high-level voltage of the first control signal CS1. Here, a change in the voltage of the second control node VA2 from a high-level voltage to a low-level voltage corresponds to the start of the discharge of the second capacitor C2 and the fourth capacitor C4.

Accordingly, the discharge of the second capacitor C2 and the fourth capacitor C4 can be triggered by the charge of the first capacitor C1 and the third capacitor C3. The discharge of the second capacitor C2 and the fourth capacitor C4 can correspond to the charge of the first capacitor C1 and the third capacitor C3.

Referring to FIG. 6, the first charge/discharge control circuit CDC1 can include a first charge controller CT1, a first discharge controller DT1, and a first discharge auxiliary controller DAT1.

The first charge controller CT1 can be electrically connected between a first supply node Ns1 and the first control node VA1, and can be on-off controlled by the first control signal CS1.

The first discharge controller DT1 can be electrically connected between the first supply node Ns1 and the first control node VA1, and can be on-off controlled by a first discharge signal, by which the discharge of the first capacitor C1 and the third capacitor C3 is triggered.

The first discharge auxiliary controller DAT1 can be electrically connected between the first supply node Ns1 and the first control node VA1, and can be on-off controlled by a first discharge auxiliary signal by which the discharge of the first capacitor C1 and the third capacitor C3 is maintained.

A second charge/discharge control circuit CDC2 can include a second charge controller CT2, a second discharge controller DT2, and a second discharge auxiliary controller DAT2. The second charge controller CT2, the second discharge controller DT2, and the second discharge auxiliary controller DAT2 can be control elements.

The second charge controller CT2 can be electrically connected between a second supply node Ns2 and the second control node VA2, and can be on-off controlled by the second control signal CS2.

The second discharge controller DT2 can be electrically connected between the second supply node Ns2 and the second control node VA2, and can be on-off controlled by a second discharge signal by which the discharge of the second capacitor C2 and the fourth capacitor C4 is triggered.

The second discharge auxiliary controller DAT2 can be electrically connected between the second supply node Ns2 and the second control node VA2, and can be on-off controlled by a second discharge auxiliary signal by which the discharge of the second capacitor C2 and the fourth capacitor C4 is maintained.

Referring to FIG. 6, the first charge/discharge control circuit CDC1 uses the second control signal CS2 of the second charge/discharge control circuit CDC2 as a first discharge signal thereof, and uses the second control auxiliary signal CAS2 of the second charge/discharge control circuit CDC2 as a first discharge auxiliary signal thereof.

In contrast, the second charge/discharge control circuit CDC2 uses the first control signal CS1 of the first charge/discharge control circuit CDC1 as a second discharge signal thereof, and uses the first control auxiliary signal CAS1 of the first charge/discharge control circuit CDC1 as a second discharge auxiliary signal thereof.

That is, the first discharge signal, by which the discharge of the first capacitor C1 and the third capacitor C3 is triggered, can be the same as the second control signal CS2, while the first discharge auxiliary signal, by which the discharge of the first capacitor C1 and the third capacitor C3 is maintained, can be the same as the second control auxiliary signal CAS2.

Likewise, the second discharge signal, by which the discharge of the second capacitor C2 and the fourth capacitor C4 is triggered, can be the same as the first control signal CS1, while the second discharge auxiliary signal, by which the discharge of the second capacitor C2 and the fourth capacitor C4 is maintained, can be the same as the first control auxiliary signal CAS1.

Referring to FIG. 7, the rear portion of a high-level voltage period of the first control signal CS1 can overlap the front portion of a high-level voltage period of the first control auxiliary signal CAS1.

Since the first charge/discharge control circuit CDC1 and the second charge/discharge control circuit CDC2 use signals in a crossing manner, the first control signal CS1 is the second discharge signal, and the first control auxiliary signal CAS1 is the second discharge auxiliary signal. Accordingly, the rear portion of a high-level voltage period of the second discharge signal can overlap the front portion of a high-level voltage period of the second discharge auxiliary signal.

Referring to FIG. 7, the rear portion of a high-level voltage period of the second control signal CS2 can overlap the front portion of a high-level voltage period of the second control auxiliary signal CAS2.

Since the first charge/discharge control circuit CDC1 and the second charge/discharge control circuit CDC2 use signals in a crossing manner, the second control signal CS2 is the first discharge signal, while the second control auxiliary signal CAS2 is the first discharge auxiliary signal. Accordingly, the rear portion of a high-level voltage period of the first discharge signal can overlap the front portion of a high-level voltage period of the first discharge auxiliary signal.

Referring to FIG. 7, the high-level voltage period of the first control auxiliary signal CAS1 may not overlap the high-level voltage period of the second control signal CS2.

Likewise, the high-level voltage period of the second control auxiliary signal CAS2 may not overlap the high-level voltage period of the first control signal CS1.

Referring to FIG. 7, at a point in time, the gate nodes of the first switch ST1 and the third switch ST3, corresponding to the first control node VA1, can equally have one voltage condition selected from among a first voltage condition having the low-level voltage of the first control signal CS1, a second voltage condition having the high-level voltage of the first control signal CS1, and a third voltage condition boosted from the high-level voltage of the first control signal CS1 by the high-level voltage of the first control auxiliary signal CAS1.

Referring to FIG. 7, the voltage condition of the gate nodes of the first switch ST1 and the third switch ST3, corresponding to the first control node VA1, changes in the order of the first voltage condition, the second voltage condition, the third voltage condition, the second voltage condition, and the first voltage condition (e.g., an increasing staircase followed by a decreasing staircase type of waveform).

Referring to FIG. 7, the gate nodes of the second switch ST2 and the fourth switch ST4, corresponding to the second control node VA2, can have one voltage condition selected from among a first voltage condition having the low-level voltage of the second control signal CS2, a second voltage condition having the high-level voltage of the second control signal CS2, and a third voltage condition boosted from the high-level voltage of the second control signal CS2 by the high-level voltage of the second control auxiliary signal CAS2.

Referring to FIG. 7, the voltage condition of the gate nodes of the second switch ST2 and the fourth switch ST4, corresponding to the second control node VA2, changes in the order of the first voltage condition, the second voltage condition, the third voltage condition, the second voltage condition, and the first voltage condition (e.g., an increasing staircase followed by a decreasing staircase type of waveform).

FIG. 8 schematically illustrates an area in the demultiplexer circuit area DMA, in which the first to fourth switches ST1, ST2, ST3, and ST4 are disposed.

Referring to FIG. 8, the first control node VA1 can be disposed as a signal line connected to the gate nodes of the first switch ST1 and the third switch ST3.

Likewise, the second control node VA2 can be disposed in the form of a signal line connected to the gate nodes of the second switch ST2 and the fourth switch ST4.

Referring to FIG. 8, the first control auxiliary node Na1 and the third control auxiliary node Na3 can be disposed as a signal line. A single first control auxiliary signal CAS1 can be applied to the first control auxiliary node Na1 and the third control auxiliary node Na3.

Likewise, the second control auxiliary node Na2 and fourth control auxiliary node Na4 can be disposed as a signal line. A single second control auxiliary signal CAS2 can be applied to the second control auxiliary node Na2 and fourth control auxiliary node Na4.

Referring to FIG. 8, the first control node VA1, corresponding to the gate node of the first switch ST1, and the first control auxiliary node Na1 provide the first capacitor C1.

The first control node VA1, corresponding to the gate node of the third switch ST3, and the third control auxiliary node Na3 provide the third capacitor C3.

The second control node VA2, corresponding to the gate node of the second switch ST2, and the second control auxiliary node Na2 provide the second capacitor C2.

The second control node VA2, corresponding to the gate node of the fourth switch ST4, and the fourth control auxiliary node Na4 provide the fourth capacitor C4.

Referring to FIG. 8, the source node or the drain node of the first switch ST1 can be connected to or can correspond to the first data line DL1.

The drain node or the source node of the first switch ST1 can be connected to or can correspond to the first data link line DLL1 corresponding to the first channel CH1 of the source driver IC SDIC.

The source node or the drain node of the second switch ST2 can be connected to or can correspond to the second data line DL2.

The drain node or the source node of the second switch ST2 can be connected to or can correspond to the first data link line DLL1 corresponding to the first channel CH1 of the source driver IC SDIC. Here, the drain node or the source node of the second switch ST2 can be electrically connected to the drain node or the source node of the first switch ST1, connected or integrated by a connecting pattern.

The source node or the drain node of the third switch ST3 can be connected to or can correspond to the third data line DL3.

The drain node or the source node of the third switch ST3 can be connected to or can correspond to the second data link line DLL2 corresponding to the second channel CH2 of the source driver IC SDIC.

The source node or the drain node of the fourth switch ST4 can be connected to or can correspond to the fourth data line DL4.

The drain node or the source node of the fourth switch ST4 can be connected to or can correspond to the second data link line DLL2 corresponding to the second channel CH2 of the source driver IC SDIC. Here, the drain node or the source node of the fourth switch ST4 can be electrically connected to the drain node or the source node of the third switch ST3, connected or integrated by a connecting pattern.

Referring to FIG. 8, a signal line corresponding to each of the first control node VA1 and the second control node VA2 is disposed in the entirety of the demultiplexer circuit area DMA in the non-active area N/A of the display panel PNL.

Accordingly, a variety of lines (e.g., signal lines, such as data lines and data link lines), by which load is generated, and a plurality of transistors, such as other switching elements, may inevitably be present on the first control node VA1 and second control node VA2.

Thus, a value of resistance capacitance (RC) may inevitably be increased, thereby degrading the data signal output performance of the bootstrapping demultiplexer circuit BTS_DeMUX. Accordingly, this leads to degradation in image quality.

Hereinafter, an RC-reducing bootstrapping demultiplexer circuit BTS_DeMUX able to reduce the RC value will be described.

Figure 9:
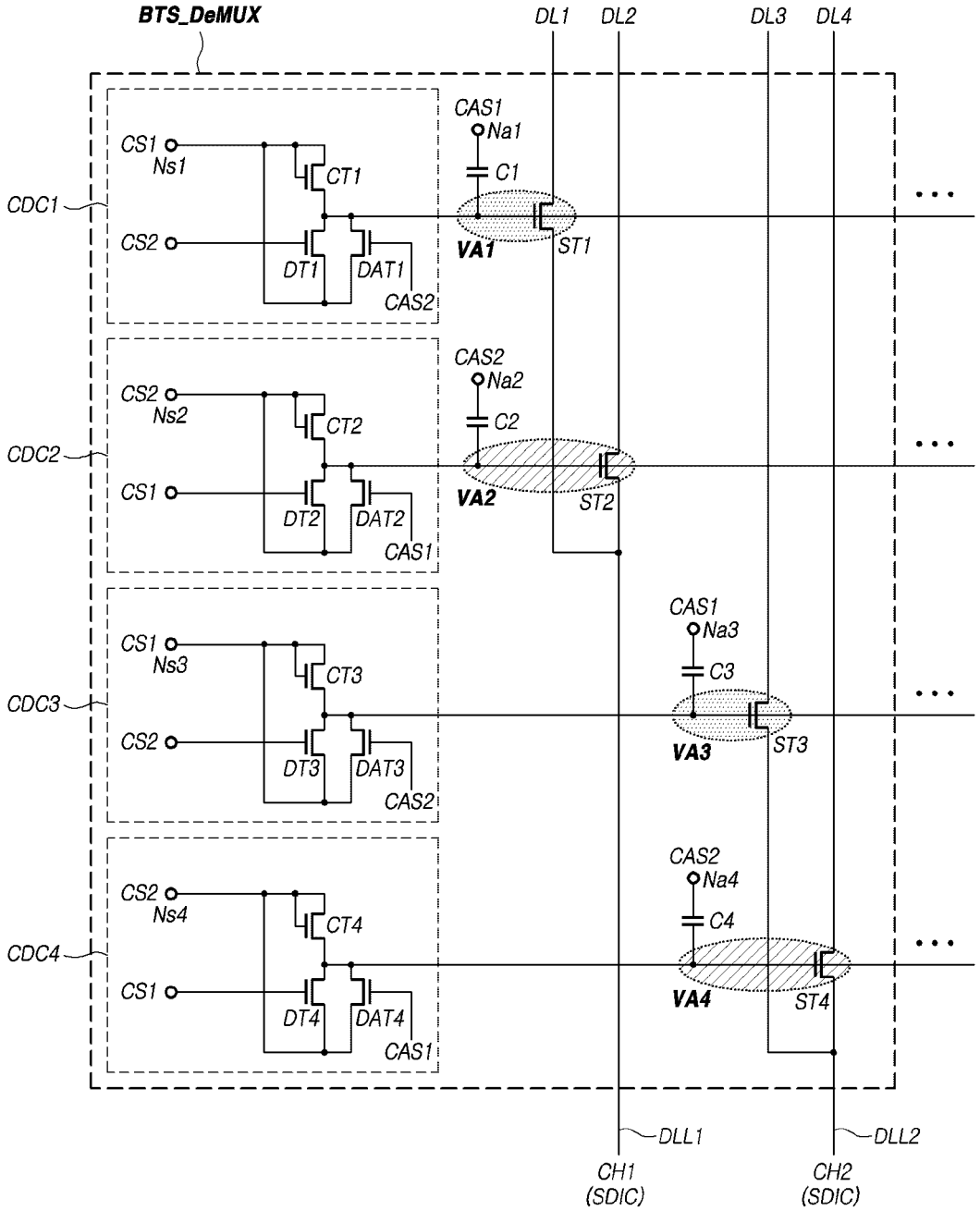
FIG. 9 illustrates an RC-reducing bootstrapping demultiplexer circuit according to embodiments.
Figure 10:
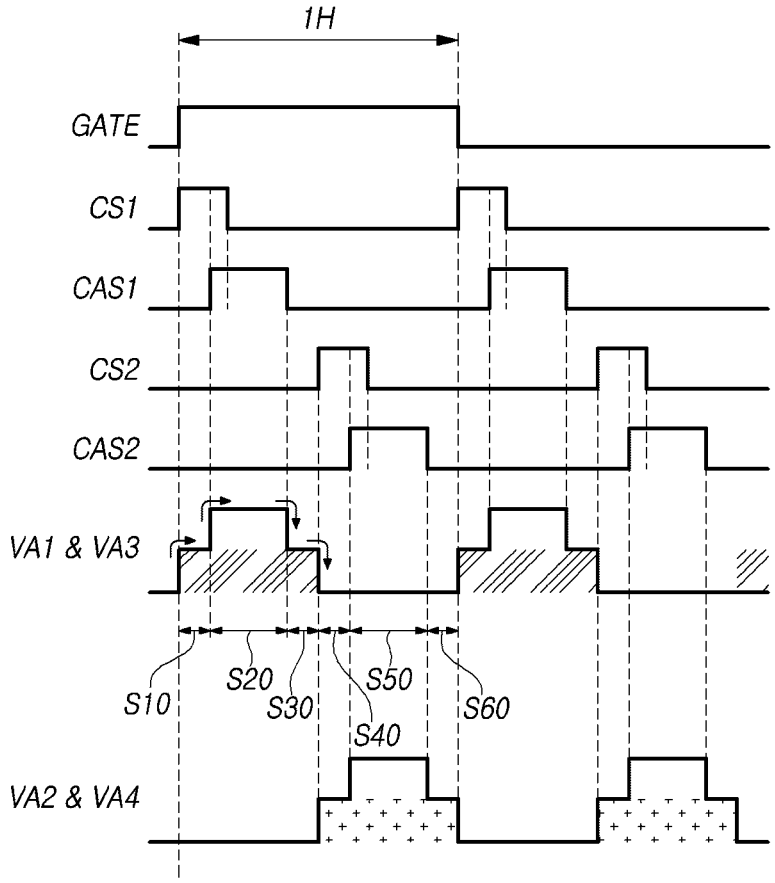
FIG. 10 is a driving timing diagram of the RC-reducing bootstrapping demultiplexer circuit illustrated in FIG. 9 according to embodiments.
Figure 11:
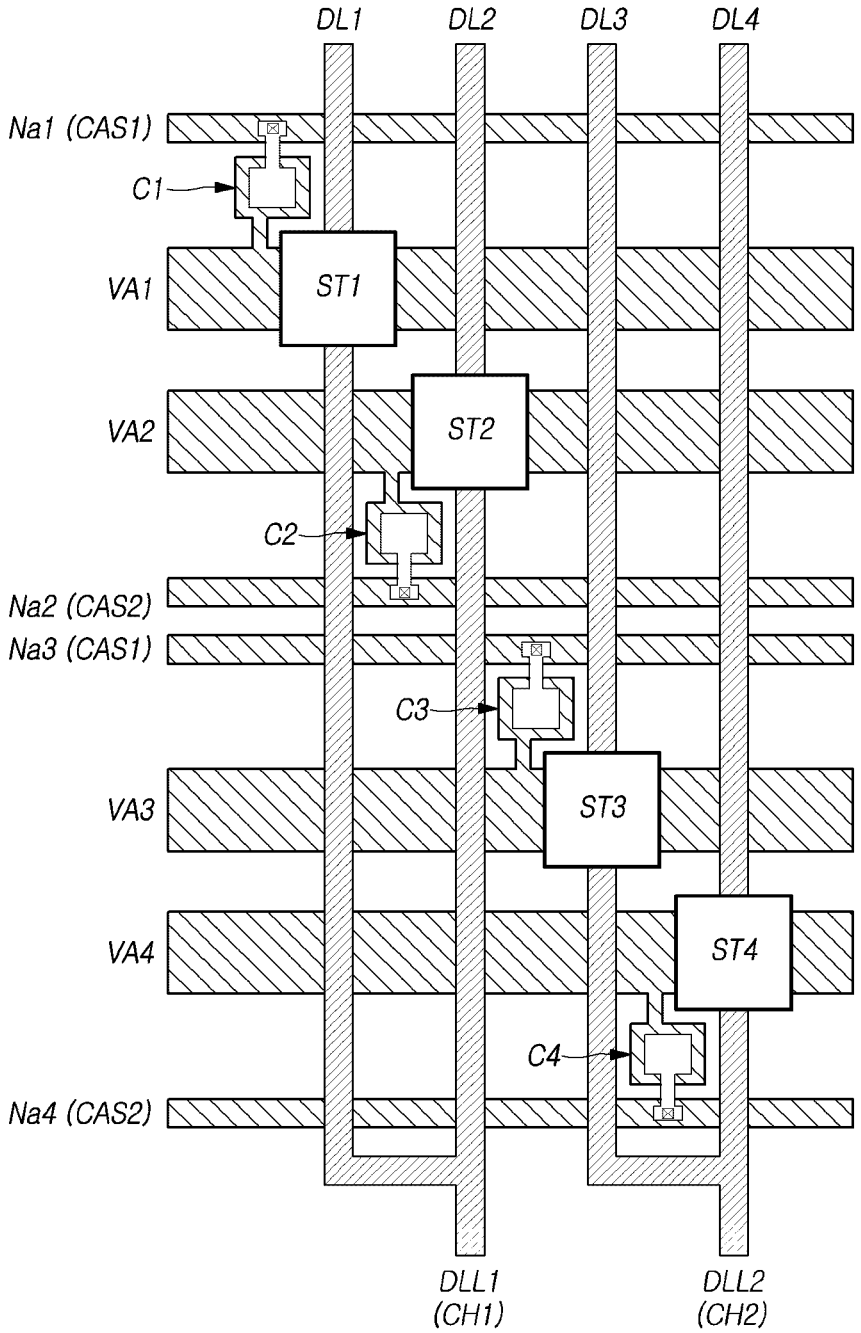
FIG. 11 is a plan view of an area in the RC-reducing bootstrapping demultiplexer circuit according to embodiments, in which the first to fourth switches are fabricated.
Figure 12:
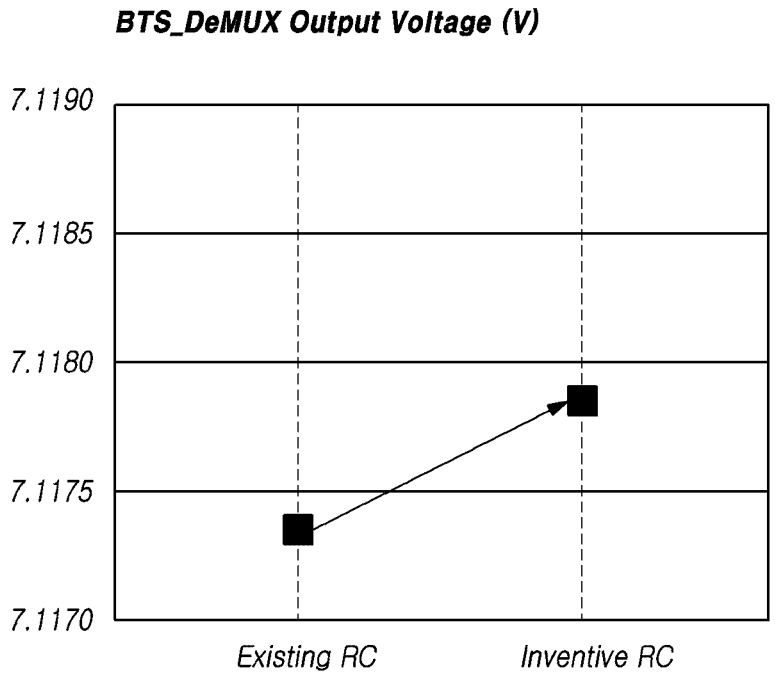
FIGS. 12 and 13 are graphs illustrating improvements in the state of charge of pixels and the charge/discharge performance of the RC-reducing bootstrapping demultiplexer circuit according to embodiments.
Figure 13:
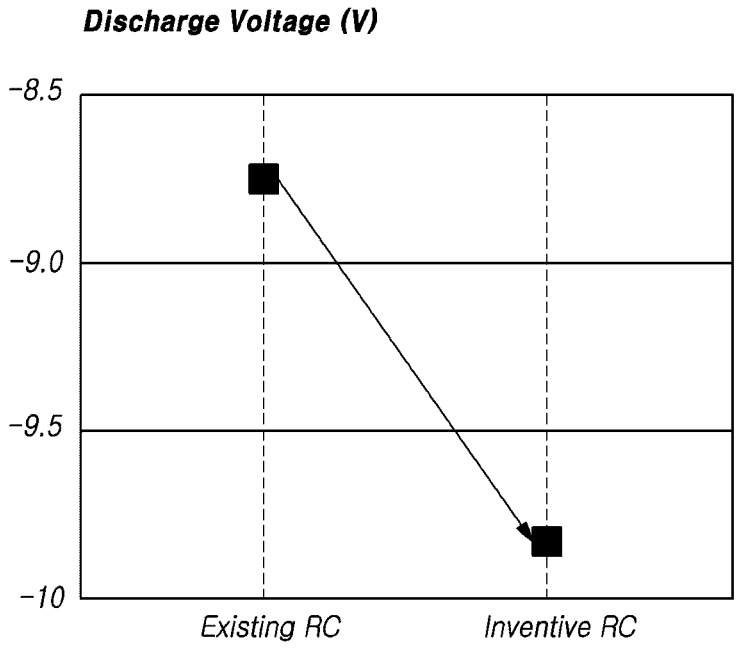

FIG. 9 illustrates the RC-reducing bootstrapping demultiplexer circuit BTS_DeMUX according to embodiments. FIG. 10 is a driving timing diagram of the RC-reducing bootstrapping demultiplexer circuit BTS_DeMUX illustrated in FIG. 9. FIG. 11 is a plan view of an area in the RC-reducing bootstrapping demultiplexer circuit BTS_DeMUX according to embodiments, in which the first to fourth switches ST1 to ST4 are fabricated. FIGS. 12 and 13 are graphs illustrating improvements in the state of charge of pixels and the charge/discharge performance of the RC-reducing bootstrapping demultiplexer circuit BTS_DeMUX according to embodiments.

Referring to FIG. 9, the RC-reducing bootstrapping demultiplexer circuit BTS_DeMUX according to embodiments is a circuit sequentially outputting a data signal, supplied by the data driver DDR, to the plurality of data lines DL disposed in the display panel PNL.

Referring to FIG. 9, the RC-reducing bootstrapping demultiplexer circuit BTS_DeMUX according to embodiments can include a first switch ST1, a second switch ST2, a third switch ST3, a fourth switch ST4, and the like.

The first switch ST1 can be on-off controlled by the voltage of the first control node VA1, and when turned on, electrically connect the first data link line DLL1, corresponding to the first channel CH1, and the first data line DL1.

The second switch ST2 can be on-off controlled by the voltage of the second control node VA2, and when turned on, electrically connect the first data link line DLL1, corresponding to the first channel CH1, and the second data line DL2.

The third switch ST3 can be on-off controlled by the voltage of the voltage of a third control node VA3, and when turned on, electrically connect the second data link line DLL2, corresponding to the second channel CH2, and the third data line DL3.

The fourth switch ST4 can be on-off controlled by the voltage of the voltage of a fourth control node VA4, and when turned on, electrically connect the second data link line DLL2, corresponding to the second channel CH2, and the fourth data line DL4.

A single first control signal CS1 can be applied to the first control node VA1 and the third control node VA3.

The first control node VA1 and the third control node VA3 are electrically disconnected from each other at a certain point in time. More specifically, referring to FIGS. 9 and 10, at a point in time at which all of the first control signal CS1, a second control signal CS2, and a second control auxiliary signal CAS2 enter a low-level voltage period, the first control node VA1 and the third control node VA3 are electrically disconnected from each other.

A single second control signal CS2 is applied to the second control node VA2 and the fourth control node VA4.

The second control node VA2 and the fourth control node VA4 are electrically disconnected from each other at a point in time at which the single second control signal CS2 is applied thereto. More specifically, referring to FIGS. 9 and 10, at a point in time at which all of the second control signal CS2, the first control signal CS1, and a first control auxiliary signal CAS1 enter a low-level voltage period, the second control node VA2 and the fourth control node VA4 are electrically disconnected from each other.

Referring to FIGS. 9 and 10, the first control node VA1 and the third control node VA3 can have different voltage conditions from the second control node VA2 and the fourth control node VA4.

Referring to FIGS. 9 and 10, even in the situation that the first control node VA1 and the third control node VA3 are electrically disconnected from each other at a certain point in time, due to the same voltage condition, the first switch ST1 and the third switch ST3 can have the same on-off timing. In other words, the first and third switches can be turned on and off at the same time by the same signal (CS1), but they can be electrically isolated from each other, in order to further reduce parasitic capacitance within the demultiplexer.

Referring to FIGS. 9 and 10, even in the situation that the second control node VA2 and the fourth control node VA4 are electrically disconnected from each other at a certain point in time, due to the same voltage condition, the second switch ST2 and the fourth switch ST4 can have the same on-off timing. In other words, the second and fourth switches can be turned on and off at the same time by the same signal (CS2), but they can be electrically isolated from each other, in order to further reduce parasitic capacitance within the demultiplexer.

Referring to FIGS. 9 and 10, since the first control node VA1 and the third control node VA3 have different voltage conditions from the second control node VA2 and the fourth control node VA4, the first switch ST1 and the third switch ST3 can have different on-off timing from the second and fourth switches.

Referring to FIG. 9, the demultiplexer circuit BTS_DeMUX can include: a first capacitor C1 electrically connected between the first control auxiliary node Na1 and the first control node VA1; a second capacitor C2 electrically connected between the second control auxiliary node Na2 and the second control node VA2; a third capacitor C3 electrically connected between the third control auxiliary node Na3 and the third control node VA3; and a fourth capacitor C4 electrically connected between the fourth control auxiliary node Na4 and the fourth control node VA4.

Referring to FIG. 9, the demultiplexer circuit BTS_DeMUX can include a first charge/discharge control circuit CDC1 controlling the charge and discharge of the first capacitor C1; a second charge/discharge control circuit CDC2 controlling the charge and discharge of the second capacitor C2; a third charge/discharge control circuit CDC3 controlling the charge and discharge of the third capacitor C3; and a fourth charge/discharge control circuit CDC4 controlling the charge and discharge of the fourth capacitor C4.

Referring to FIG. 9, a single control auxiliary signal CAS1 can be applied to both the first control auxiliary node Na1 and the third control auxiliary node Na3.

Likewise, a single second control auxiliary signal CAS2 can be applied to both the second control auxiliary node Na2 and the fourth control auxiliary node Na4.

Referring to FIGS. 9 and 10, since the single first control signal CS1 is applied to both the first control node VA1 and the third control node VA3, and the single control auxiliary signal CAS1 is applied to both the first control auxiliary node Na1 and the third control auxiliary node Na3, the first capacitor C1 and the third capacitor C3 can both have the same charge and discharge times.

Referring to FIGS. 9 and 10, since the single second control signal CS2 is applied to the second control node VA2 and the fourth control node VA4, and the single second control auxiliary signal CAS2 is applied to the second control auxiliary node Na2 and the fourth control auxiliary node Na4, the second capacitor C2 and the fourth capacitor C4 can have the same charge and discharge times.

Referring to FIGS. 9 and 10, the discharge of the first capacitor C1 and the third capacitor C3 is performed when the second control signal CS2 is changed to a high-level voltage to charge the second capacitor C2 and the fourth capacitor C4. Consequently, the discharge of the first capacitor C1 and the third capacitor C3 can be triggered by the charge of the second capacitor C2 and the fourth capacitor C4.

Referring to FIGS. 9 and 10, the discharge of the second capacitor C2 and the fourth capacitor C4 is performed when the first control signal CS1 is changed to a high-level voltage to charge the first capacitor C1 and the third capacitor C3. Consequently, the discharge of the second capacitor C2 and the fourth capacitor C4 can be triggered by the charge of the first capacitor C1 and the third capacitor C3.

Referring to FIGS. 9 and 10, the first charge/discharge control circuit CDC1 can include: a first charge controller CT1 electrically connected between the first supply node Ns1 and the first control node VA1 to be on-off controlled by a first control signal CS1; a first discharge controller DT1 electrically connected between the first supply node Ns1 and the first control node VA1 to be on-off controlled by a first discharge signal, by which the first capacitor C1 is discharged; and a first discharge auxiliary controller DAT1 electrically connected between the first supply node Ns1 and the first control node VA1 to be on-off controlled by a first discharge auxiliary signal, by which the discharge of the first capacitor C1 is maintained.

Here, the first discharge signal, by which the first capacitor C1 is discharged, is the same as the second control signal CS2, by which the second capacitor C2 is charged. The first discharge auxiliary signal, by which the discharge of the first capacitor C1 is maintained, is the same as the second control auxiliary signal CAS2, by which the charge of the second capacitor C2 is maintained (or the second capacitor C2 is boosted).

The second charge/discharge control circuit CDC2 can include: a second charge controller CT2 electrically connected between the second supply node Ns2 and the second control node VA2 to be on-off controlled by the second control signal CS2; a second discharge controller DT2 electrically connected between the second supply node Ns2 and the second control node VA2 to be on-off controlled by the second discharge signal, by which the second capacitor C2 is discharged; and a second discharge auxiliary controller DAT2 electrically connected between the second supply node Ns2 and the second control node VA2 to be on-off controlled by the second discharge auxiliary signal, by which the discharge of the second capacitor C2 is maintained.

Here, the second discharge signal, by which the second capacitor C2 is discharged, is the same as the first control signal CS1, by which the first capacitor C1 is charged. The second discharge auxiliary signal, by which the discharge of the second capacitor C2 is maintained, is the same as the first control auxiliary signal CAS1, by which the charge of the first capacitor C1 is maintained (or the first capacitor C1 is boosted).

The third charge/discharge control circuit CDC3 can include: a third charge controller CT3 electrically connected between a third supply node Ns3 and the third control node VA3 to be on-off controlled by the first control signal CS1; a third discharge controller DT3 electrically connected between the third supply node Ns3 and the third control node VA3 to be on-off controlled by a third discharge signal, by which the third capacitor C3 is discharged; and a third discharge auxiliary controller DAT3 electrically connected between the third supply node Ns3 and the third control node VA3 to be on-off controlled by a third discharge auxiliary signal, by which the discharge of the third capacitor C3 is maintained.

Here, the third discharge signal, by which the third capacitor C3 is discharged, is the same as the first discharge signal, by which the first capacitor C1 is discharged. The third discharge auxiliary signal, by which the discharge of the third capacitor C3 is maintained, is the same as the first discharge auxiliary signal, by which the discharge of the third capacitor C3 is maintained, and is the same as the second control auxiliary signal CAS2.

The fourth charge/discharge control circuit CDC4 can include: a fourth charge controller CT4 electrically connected between a fourth supply node Ns4 and the fourth control node VA4 to be on-off controlled by the second control signal CS2; a fourth discharge controller DT4 electrically connected between the fourth supply node Ns4 and the fourth control node VA4 to be on-off controlled by a fourth discharge signal, by which the fourth capacitor C4 is discharged; and a fourth discharge auxiliary controller DAT4 electrically connected between the fourth supply node Ns4 and the fourth control node VA4 to be on-off controlled by a fourth discharge auxiliary signal, by which the discharge of the fourth capacitor C4 is maintained.

Here, the fourth discharge signal, by which the fourth capacitor C4 is discharged, is the same as the second discharge signal, by which the second capacitor C2 is discharged, while the fourth discharge auxiliary signal, by which the discharge of the fourth capacitor C4 is maintained, is the same as the second discharge auxiliary signal, by which the discharge of the second capacitor C2 is maintained, and is the same as the first control auxiliary signal CAS1.

Referring to FIG. 9, a single first control signal CS1 is applied to the first supply node Ns1 and the third supply node Ns3, and a single second control signal CS2 is applied to the second supply node Ns2 and the fourth supply node Ns4.

Referring to FIGS. 9 and 10, the first charge/discharge control circuit CDC1 and the third charge/discharge control circuit CDC3 use the second control signal CS2, e.g., the charge signal of the second charge/discharge control circuit CDC2 and the fourth charge/discharge control circuit CDC4, as the first and third discharge signals, e.g., the discharge signal thereof.

In addition, the first charge/discharge control circuit CDC1 and the third charge/discharge control circuit CDC3 use the second control auxiliary signal CAS2, e.g., the boosting signal of the second charge/discharge control circuit CDC2 and the fourth charge/discharge control circuit CDC4, as the first and third discharge auxiliary signals, e.g., the discharge auxiliary signals (or discharge maintenance signal) thereof.

The second charge/discharge control circuit CDC2 and the fourth charge/discharge control circuit CDC4 use the first control signal CS1, e.g., the charge signal of the first charge/discharge control circuit CDC1 and the third charge/discharge control circuit CDC3, as the second and fourth discharge signals, e.g., the discharge signal thereof.

In addition, the second charge/discharge control circuit CDC2 and the fourth charge/discharge control circuit CDC4 use the first control auxiliary signal CAS1, e.g., the boosting signal of the first charge/discharge control circuit CDC1 and the third charge/discharge control circuit CDC3, as the second and fourth discharge auxiliary signals, e.g., the discharge auxiliary signal (or discharge maintenance signal) thereof.

Referring to FIG. 10, the rear portion of the high-level voltage period of the first control signal CS1 can overlap the front portion of the high-level voltage period of the first control auxiliary signal CAS1.

Since the first and third charge/discharge control circuits CDC1 and CDC3 and the second and fourth charge/discharge control circuits CDC2 and CDC4 use signals in a crossing manner, the first control signal CS1, e.g., the charge signal of the first charge/discharge control circuit CDC1 and the third charge/discharge control circuit CDC3, is the second and fourth discharge signals, e.g., the discharge signal of the second charge/discharge control circuit CDC2 and the fourth charge/discharge control circuit CDC4.

In addition, the first control auxiliary signal CAS1, e.g., the boosting signal of the first charge/discharge control circuit CDC1 and the third charge/discharge control circuit CDC3, is the second and fourth discharge auxiliary signals, e.g., the discharge auxiliary signal (or discharge maintenance signal) of the second charge/discharge control circuit CDC2 and the fourth charge/discharge control circuit CDC4.

Referring to FIG. 10, the rear portion of the high-level voltage period of the second control signal CS2 can overlap the front portion of the high-level voltage period of the second control auxiliary signal CAS2.

Since the first and third charge/discharge control circuits CDC1 and CDC3 and the second and fourth charge/discharge control circuits CDC2 and CDC4 use signals in a crossing manner, the second control signal CS2, e.g., the charge signal of the second charge/discharge control circuit CDC2 and the fourth charge/discharge control circuit CDC4, is the first discharge signal, by which the first capacitor C1 is discharged, e.g., the discharge signal of the first charge/discharge control circuit CDC1 and the third charge/discharge control circuit CDC3.

In addition, the second control auxiliary signal CAS2, e.g., the boosting signal of the second charge/discharge control circuit CDC2 and the fourth charge/discharge control circuit CDC4, is the first and third discharge auxiliary signals, e.g., the discharge auxiliary signal (or discharge maintenance signal) of the first charge/discharge control circuit CDC1 and the third charge/discharge control circuit CDC3.

Referring to FIG. 10, the high-level voltage period of the first control auxiliary signal CAS1 does not overlap the high-level voltage period of the second control signal CS2. In addition, the high-level voltage period of the second control auxiliary signal CAS2 does not overlap the high-level voltage period of the first control signal CS1.

Referring to FIG. 10, the rear portion of the high-level voltage period of the second control signal CS2, e.g., the discharge signal for the discharge of the first and third capacitors C1 and C3, overlaps the front portion of the high-level voltage period of the second control auxiliary signal CAS2, e.g., the discharge auxiliary signal for the maintenance of the discharge of the first and third capacitors C1 and C3.

In addition, the rear portion of the high-level voltage period of the first control signal CS1, e.g., the discharge signal for the discharge of the second and the fourth capacitors C2 and C4, overlaps the front portion of the high-level voltage period of the first control auxiliary signal CAS1, e.g., the discharge auxiliary signal for the maintenance of the discharge of the second and fourth capacitors C2 and C4.

At a point in time, each of the first control node VA1 and the third control node VA3 can equally have one voltage condition selected from among a first voltage condition having the low-level voltage of the first control signal CS1, a second voltage condition having the high-level voltage of the first control signal CS1, and a third voltage condition boosted from the high level voltage of the first control signal CS1 by the high-level voltage of the first control auxiliary signal CAS1.

At a point in time, each of the second control node VA2 and the fourth control node VA4 can equally have one voltage condition selected from among a first voltage condition having the low-level voltage of the second control signal CS2, a second voltage condition having the high-level voltage of the second control signal CS2, and a third voltage condition boosted from the high level voltage of the second control signal CS2 by the high level voltage of the second control auxiliary signal CAS2.

The driving operation will be described with reference to FIG. 10. In the following description, a situation in which the first charge/discharge control circuit CDC1 controls the charge/discharge of the first capacitor C1 and the on-off operation of the first switch ST1 will be taken for the sake of brevity. In the following description, for the sake of brevity, the low-level voltage and the high-level voltage of all of the first control signal CS1, the first control auxiliary signal CAS1, the second control signal CS2, and the second control auxiliary signal CAS2 will be regarded as being 0V and 30V. In addition, the high-level voltage 30V will be regarded as a voltage by which the first switch ST1 can be turned on.

The driving operation of the first charge/discharge control circuit CDC1 includes a charge operation S10, a boosting operation S20, a falling operation S30, a discharge operation S40, a discharge maintaining operation S50, and a reset operation S60.

The charge operation S10 is an operation of charging the first capacitor C1.

In the charge operation S10, the first control signal CS1 has a high-level voltage. All of the first control auxiliary signal CAS1, the second control signal CS2, and the second control auxiliary signal CAS2 have a low-level voltage.

Accordingly, the first charge controller CT1 is turned on. The first control signal CS1 having the high-level voltage is transferred to the first control node VA1 via the first charge controller CT1 diode-connected to the first control node VA1.

Thus, the first control node VA1 and the first control auxiliary node Na1, corresponding to both ends of the first capacitor C1, have the high-level voltage (e.g., 30V) of the first control signal CS1 and the low-level voltage (e.g., 0V) of the first control auxiliary signal CAS1. Accordingly, the first capacitor C1 is charged, due to the potential difference (e.g., 30V) between both ends.

In addition, since the first control signal CS1 having the high-level voltage is applied to the first control node VA1 corresponding to the gate node of the first switch ST1, the first switch ST1 is turned on.

Accordingly, a first data signal, output from the first channel CH1 of the source driver IC SDIC, is supplied to the first data line DL1 via the turned-on first switch ST1.

The boosting operation S20 is an operation of boosting the voltage of the first control node VA1.

During the boosting operation S20, the first control signal CS1 maintains the high-level voltage before being lowered to the low-level voltage state. The first control auxiliary signal CAS1 is boosted to the high-level voltage state, along with the start of the boosting operation S20, and maintains the high-level voltage during the boosting operation S20.

During the boosting operation S20, the second control signal CS2 and the second control auxiliary signal CAS2 have the low-level voltage.

During the boosting operation S20, although the potential difference 30V between both ends of the first capacitor C1 is maintained, the first control auxiliary signal CAS1, applied to one end of the first capacitor C1, is raised to the high-level voltage (e.g., 30V), so that the voltage of the first control node VA1, corresponding to the other end of the first capacitor C1, is boosted from the high-level voltage (e.g., 30V) by the high-level voltage (e.g., 30V) of the first control auxiliary signal CAS1.

Consequently, the first control node VA1 has a voltage 30V+30V=60V, boosted from the high-level voltage (e.g. 30V) of the first control signal CS1 by the high-level voltage (e.g. 30V) of first control auxiliary signal CAS1.

During the boosting operation S20, the first switch ST1 maintains the turned-on state, since the first control node VA1 has the boosted voltage 60V. Consequently, the first data signal, output from the first channel CH1 of the source driver IC SDIC, is supplied to the first data line DL1 via the turned-on first switch ST1.

The falling operation S30 is an operation in which the boosted voltage 60V of the first control node VA1 falls to the pre-boosting voltage 30V, e.g., the voltage before being boosted.

In the falling operation S30, the first control auxiliary signal CAS1 is lowered from the high-level voltage (e.g., 30V) to the low-level voltage (e.g., 0V).

Consequently, although the potential difference 30V between both ends of the first capacitor C1 is maintained, the first control auxiliary signal CAS1, applied to one end of the first capacitor C1, is lowered to the low-level voltage (e.g., 0V), so that the voltage of the first control node VA1, corresponding to the other end of the first capacitor C1, falls from the boosted voltage 60V to the pre-boosting voltage 30V.

In the falling operation S30, the first switch ST1 maintains the turned-on state, since the voltage of the first control node VA1 still can turn the first switch ST1 on even when lowered to the pre-boosting high-level voltage 30V. Consequently, the first data signal, output from the first channel CH1 of the source driver IC SDIC, is supplied to the first data line DL1 via the turned-on first switch ST1.

The discharge operation S400 in which the first capacitor C1 is discharged.

In the discharge operation S400, the second control signal CS2, corresponding to the first discharge signal, by which the first capacitor C1 is discharged, is raided from the low-level voltage to the high-level voltage (e.g., this corresponds to the charge operation S10 from the point of view of the second charge/discharge control circuit CDC2 and the fourth charge/discharge control circuit CDC4).

During the discharge operation S400, the first control signal CS1 and the first control auxiliary signal CAS1 have the low-level voltage.

Consequently, the first discharge controller DT1 is turned on.

Accordingly, the other end of the first capacitor C1 has the high-level voltage 30V, and the first control signal CS1 has the low-level voltage 0V, so that first capacitor C1 is discharged via the first discharge controller DT1. That is, the first discharge controller DT1 is turned on, so that the first control node VA1 has the low-level voltage of the first control signal CS1.

In the discharge operation S400, the first switch ST1 is turned off, since the voltage of the first control node VA1 is lowered to the low-level voltage of the first control signal CS1. Consequently, the supply of the data signal to the first data line DL1 is stopped.

When the discharge maintaining operation S50 proceeds after the discharge operation S400, the second control signal CS2 remains in the high-level voltage before being lowered to the low-level voltage. The second control auxiliary signal CAS2 is raised to the high-level voltage, along with the start of the discharge maintaining operation S50, and maintains the high-level voltage during the discharge maintaining operation S50 (e.g., this corresponds to the boosting operation S20 in the point of view of the second charge/discharge control circuit CDC2 and the fourth charge/discharge control circuit CDC4.)

During the discharge maintaining operation S50, although the first discharge controller DT1 is turned on, due to the second control signal CS2 being lowered to the low-level voltage, the second control auxiliary signal CAS2 has the high-level voltage. Consequently, the first discharge auxiliary controller DAT1 is turned on, so that first control node VA1 maintains the low-level voltage of the first control signal CS1.

During the reset operation S60 after the discharge maintaining operation S50, the second control auxiliary signal CAS2 is lowered to the low-level voltage, and all of the remaining signals CS1, CAS1, and CS2 have the low-level voltage.

The reset operation S60 proceeds until a single pulse of the gate signal is terminated. That is, the reset operation S60 proceeds before the next single horizontal time 1H.

The six operations S10 to S60 as described above proceed at the same timing also in the third charge/discharge control circuit CDC3.

The second charge/discharge control circuit CDC2 and the fourth charge/discharge control circuit CDC4 can execute the above-described six operations S10 to S60 in the same manner from the point in time at which the second control signal CS2 is raised to the high-level voltage.

Here, the first to fourth switches ST1, ST2, ST3, and ST4 can be, for example, oxide transistors, an active layer of which is an oxide semiconductor.

In addition, the other elements, such as CT1, DT1, ADT1, CT2, DT2, ADT2, CT3, DT3, ADT3, CT4, DT4, and ADT4, included in the first to fourth charge/discharge control circuits CDC1, CDC2, CDC3, and CDC4, can be, for example, oxide transistors, an active layer of which is an oxide semiconductor.

Returning to FIGS. 1 to 3, the display panel PNL can include the active area A/A, e.g., an image display area, and the non-active area N/A, at the periphery of the active area A/A.

Referring to FIG. 3, the RC-reducing bootstrapping demultiplexer circuit BTS_DeMUX illustrated in FIG. 9 can be disposed in the demultiplexer circuit area DMA in the non-active area N/A.

Referring to FIG. 3, the non-active area N/A of the display panel PNL can include the pad area PAD, to which the first channel CH1 and the second channel CH2 of the data driver DDR are electrically connected, and the link area LKA, in which the first data link line DLL1 and the second data link line DLL2, electrically connected to the first channel CH1 and the second channel CH2 via the pad area PAD, are disposed.

The RC-reducing bootstrapping demultiplexer circuit BTS_DeMUX can electrically connect one selected from the first data line DL1 and the second data line DL2, disposed in the active area A/A, to the first data link line DLL1, and electrically connect one selected from the second and fourth data lines, disposed in the active area A/A, to the second data link line DLL2.

Referring to FIGS. 2 and 3, the source driver ICs SDIC of the data driver DDR can be mounted on the circuit films SF electrically connected to the non-active area N/A of the display panel PNL.

FIG. 11 schematically illustrates an area of the demultiplexer circuit area DMA, in which the first to fourth switches ST1, ST2, ST3, and ST4 are disposed.

Referring to FIG. 11, the first control node VA1 can be disposed as a signal line connected to the gate node of the first switch ST1.

The second control node VA2 can be disposed as a signal line connected to the gate node of the second switch ST2. The third control node VA3 can be disposed as a signal line connected to the gate node of the third switch ST3. The fourth control node VA4 can be disposed as a signal line connected to the gate node of the fourth switch ST4.

Referring to FIG. 11, the first control auxiliary node Na1 can be disposed as a signal line, to which the first control auxiliary signal CAS1 is applied.

The second control auxiliary node Na2 can be disposed as a signal line, to which the second control auxiliary signal CAS2 is applied.

The third control auxiliary node Na3 can be disposed as a signal line, to which the first control auxiliary signal CAS1 is applied.

The fourth control auxiliary node Na4 can be disposed as a signal line, to which the second control auxiliary signal CAS2 is applied.

Referring to FIG. 11, the first control node VA1 and the first control auxiliary node Na1, corresponding to the gate node of the first switch ST1, provide the first capacitor C1.

The second control node VA2 and the second control auxiliary node Na2, corresponding to the gate node of the second switch ST2, provide the second capacitor C2.

The third control node VA3 and the third control auxiliary node Na3, corresponding to the gate node of the third switch ST3, provide the third capacitor C3.

The fourth control node VA4 and the fourth control auxiliary node Na4, corresponding to the gate node of the fourth switch ST4, provide the fourth capacitor C4.

Referring to FIG. 11, the source node or the drain node of the first switch ST1 can be connected to or can correspond to the first data line DL1.

The drain node or the source node of the first switch ST1 can be connected to or can correspond to the first data link line DLL1 corresponding to the first channel CH1 of the source driver IC SDIC.

The source node or the drain node of the second switch ST2 can be connected to or can correspond to the second data line DL2.

The drain node or the source node of the second switch ST2 can be connected to or can correspond to the first data link line DLL1 corresponding to the first channel CH1 of the source driver IC SDIC. Here, the drain node or the source node of the second switch ST2 can be electrically connected to the drain node or the source node of the first switch ST1, connected or integrated by a connecting pattern.

The source node or the drain node of the third switch ST3 can be connected to or can correspond to the third data line DL3 of the third data line DL3.

The drain node or the source node of the third switch ST3 can be connected to or can correspond to the second data link line DLL2 corresponding to the second channel CH2 of the source driver IC SDIC.

The source node or the drain node of the fourth switch ST4 can be connected to or can correspond to the fourth data line DL4.

The drain node or the source node of the fourth switch ST4 can be connected to or can correspond to the second data link line DLL2 corresponding to the second channel CH2 of the source driver IC SDIC. Here, the drain node or the source node of the fourth switch ST4 can be electrically connected to the drain node or the source node of the third switch ST3, connected or integrated by a connecting pattern.

Referring to FIG. 11, signal lines corresponding to the first to fourth control nodes VA1, VA2, VA3, and VA4, respectively, are disposed in the entirety of the demultiplexer circuit area DMA in the non-active area N/A of the display panel PNL.

However, the structure illustrated in FIGS. 9 and 11 ensures that load is distributed across the first to fourth control nodes VA1, VA2, VA3, and VA4, unlike the structure illustrated in FIGS. 6 and 8. Thus, the load applied to each of the first to fourth control nodes VA1, VA2, VA3, and VA4 is reduced.

In other words, parasitic capacitance generated between each of the first to fourth control nodes VA1, VA2, VA3, and VA4 and any one of the surrounding electrodes or lines, according to the structure illustrated in FIGS. 9 and 11, is reduced substantially by half compared to parasitic capacitance generated between each of the first and fourth control nodes VA1 and VA4 and any one of the surrounding electrodes or lines, according to the structure illustrated in FIGS. 6 and 8.

Accordingly, in the RC-reducing bootstrapping demultiplexer circuit BTS_DeMUX according to embodiments, the gate nodes of the first to fourth switches ST1, ST2, ST3, and ST4 are divided to correspond to the first to fourth control nodes VA1, VA2, VA3, and VA4, the RC value on each of the first to fourth control nodes VA1, VA2, VA3, and VA4 can be reduced.

Accordingly, the data signal output performance of the RC-reducing bootstrapping demultiplexer circuit BTS_DeMUX according to embodiments can be improved, thereby improving image quality.

A more detailed description will be provided with reference to FIGS. 12 and 13.

The RC value of the RC-reducing bootstrapping demultiplexer circuit BTS_DeMUX illustrated in FIG. 9 is reduced, compared to the RC value of the bootstrapping demultiplexer circuit BTS_DeMUX illustrated in FIG. 6.

As illustrated in FIG. 12, due to the reduced RC value, the output voltage of the RC-reducing bootstrapping demultiplexer circuit BTS_DeMUX illustrated in FIG. 9 is further increased, compared to the output voltage of the bootstrapping demultiplexer circuit BTS_DeMUX illustrated in FIG. 6.

That is, due to the reduced RC value, the charge performance of the RC-reducing bootstrapping demultiplexer circuit BTS_DeMUX illustrated in FIG. 9 can be improved, compared to the charge performance of the bootstrapping demultiplexer circuit BTS_DeMUX illustrated in FIG. 6. Accordingly, the state of charge of the subpixels SP in the active area A/A of the display panel PNL can be improved.

As illustrated in FIG. 13, due to the reduced RC value, the discharge voltage of the RC-reducing bootstrapping demultiplexer circuit BTS_DeMUX illustrated in FIG. 9 is further reduced, compared to the discharge voltage of the bootstrapping demultiplexer circuit BTS_DeMUX illustrated in FIG. 6.

That is, due to the reduced RC value, the discharge performance of the RC-reducing bootstrapping demultiplexer circuit BTS_DeMUX can be improved, compared to the discharge performance of the bootstrapping demultiplexer circuit BTS_DeMUX illustrated in FIG. 6.

Figure 14:
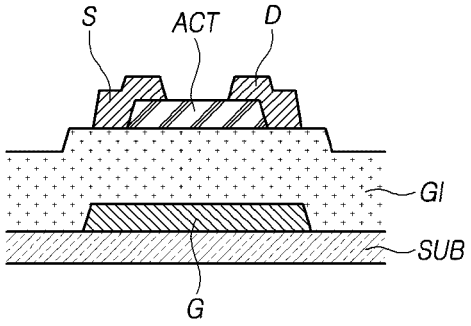
FIG. 14 illustrates the transistor structure of each of the first to fourth switches in the bootstrapping demultiplexer circuit according to embodiments.

FIG. 14 illustrates the transistor structure of each of the first to fourth switches ST1, ST2, ST3, and ST4 in the bootstrapping demultiplexer circuit BTS_DeMUX according to embodiments.

Referring to FIG. 14, each of the first to fourth switches ST1, ST2, ST3, and ST4 in the demultiplexer circuit BTS_DeMUX illustrated in FIGS. 6 and 9 can be a transistor having a back channel etch (BCE) structure, with a channel area thereof being exposed during the process of fabricating a source electrode S and a drain electrode D.

Referring to FIG. 14, the transistor having the BCE structure can include a gate electrode G, a gate insulating film GI, an oxide semiconductor layer ACT, a source electrode S, a drain electrode, and the like.

For example, in a situation in which the transistor having the BCE structure illustrated in FIG. 14 is the first switch ST1, one of the source electrode S and the drain electrode D can be electrically connected to or correspond to the first data line DL1, while the other of the source electrode S and the drain electrode D can be electrically connected to or correspond to the first data link line DLL1. The gate electrode G can be electrically connected to or correspond to the first control node VA1.

The gate electrode G is disposed on a substrate SUB, and can contain at least one selected from among, but not limited to, an aluminum-based metal, such as aluminum (Al) or an Al ally, a silver-based metal, such as silver (Ag) or an Ag alloy, a copper-based metal, such as copper (Cu) or a Cu alloy, a molybdenum-based metal, such as molybdenum (Mo) or a Mo alloy, chromium (Cr), tantalum (Ta), neodymium (Nd), and titanium (Ti). In addition, the gate electrode G can have a multilayer structure comprised of at least two conductive films having different physical properties.

The gate insulating film GI can be disposed on the gate electrode G. The gate insulating film GI, for example, can contain at least one of a silicon oxide or a silicon nitride, or can contain an aluminum oxide. The gate insulating film GI can have a monolayer structure or a multilayer structure.

The oxide semiconductor layer ACT can be disposed on the gate insulating film GI to overlap at least a portion of the gate electrode G. The oxide semiconductor layer ACT can correspond to a channel layer or an active layer. In an example, the oxide semiconductor layer ACT can contain an oxide semiconductor material. For example, the oxide semiconductor layer ACT can be made of an oxide semiconductor material, such as an InZnO (IZO)-based material, an InGaO (IGO)-based material, an InSnO (ITO)-based material, an InGaZnO (IGZO)-based material, an InGaZnSnO (IGZTO)-based material, a GaZnSnO (GZTO)-based material, a GaZnO (GZO)-based material, and an InSnZnO (ITZO)-based material. However, embodiments of the oxide semiconductor layer ACT are not limited to the above description, and can be made of other oxide semiconductor materials known in the art.

The source electrode S and the drain electrode D can be disposed on the oxide semiconductor layer ACT, spaced apart from each other. The source electrode S and the drain electrode D can contain at least one selected from among, but not limited to, Mo, Al, Cr, Au, Ti, Ni, Nd, Cu, and alloys thereof.

Each of the source electrode S and the drain electrode D can have a monolayer structure made of one of the above-mentioned metals and alloys thereof, or can have a multilayer structure comprised of two or more layers, each of which is made of one of the above-mentioned metals and alloys thereof.

For example, in portions of the oxide semiconductor layer ACT, except for a portion in which a channel is fabricated, a portion in direct or indirect contact with the source electrode S and a portion in direct or indirect contact with the drain electrode D can be portions processed to be conductive by a plasma treatment, ionization treatment, or the like.

Embodiments can provide the first to fourth switches ST1, ST2, ST3, and ST4 and the other transistors CT1, DT1, DAT1, and . . . , using the oxide TFT having the BCE structure, thereby minimizing mask processing, improving lithography process margin, and realizing superior reliability.

As set forth above, embodiments can provide demultiplexing-based data output in a reliable and appropriate manner while reducing the number of channels of the data driver DDR by means of demultiplexing-based data output.

In addition, embodiments can provide the resistance capacitance (RC)-reducing bootstrapping multiplexer circuit BTS_DeMUX and the display device 100 including the same.

In addition, embodiments can provide the bootstrapping multiplexer circuit BTS_DeMUX able to reduce unnecessary capacitance and having superior charge/discharge performance, and the display device 100 including the same.

In addition, embodiments can provide the bootstrapping multiplexer circuit BTS_DeMUX able to improve the state of charge of subpixels, and the display device 100 including the same.

The foregoing descriptions and the accompanying drawings have been presented in order to explain certain principles of the present disclosure by way of example. A person having ordinary skill in the art to which the present disclosure relates could make various modifications and variations by combining, dividing, substituting for, or changing the elements without departing from the principle of the present disclosure. The foregoing embodiments disclosed herein shall be interpreted as being illustrative, while not being limitative, of the principle and scope of the present disclosure. It should be understood that the scope of the present disclosure shall be defined by the appended Claims and all of their equivalents fall within the scope of the present disclosure.

What is claimed is:

1. A display device comprising a demultiplexer circuit for sequentially outputting a data signal, supplied by a data driver, to a plurality of data lines disposed in a display panel, wherein the demultiplexer circuit comprises:

a first switch connected to a first control node, the first switch being configured to electrically connect a first channel with a first data line among the plurality of data lines;

a second switch connected to a second control node, the second switch being configured to electrically connect the first channel with a second data line among the plurality of data lines;

a third switch connected to a third control node, the third switch being configured to electrically connect a second channel with a third data line among the plurality of data lines; and a fourth switch connected to a fourth control node, the fourth switch being configured to electrically connect the second channel with a fourth data line among the plurality of data lines, wherein the first control node and the third control node are configured to receive a single first control signal, and be electrically disconnected from each other at a point in time, wherein the second control node and the fourth control node are configured to receive a single second control signal, and be electrically disconnected from each other at a point in time, and wherein the first control node and the third control node have different voltage conditions than the second control node and the fourth control node, and wherein the demultiplexer circuit further comprises:

a first capacitor electrically connected between a first control auxiliary node and each of a gate node of the first switch and a first charge/discharge control circuit configured to control charge and discharge of the first capacitor;

a second capacitor electrically connected between a second control auxiliary node and each of a gate node of the second switch and a second charge/discharge control circuit configured to control charge and discharge of the second capacitor;

a third capacitor electrically connected between a third control auxiliary node and each of a gate node of the third switch and a third charge/discharge control circuit configured to control charge and discharge of the third capacitor; and a fourth capacitor electrically connected between a fourth control auxiliary node and each of a gate node of the fourth switch and a fourth charge/discharge control circuit configured to control charge and discharge of the fourth capacitor.

2. The display device according to claim 1, wherein a gate of the first switch is electrically connected to a gate of the third switch, and wherein a gate of the second switch is electrically connected to a gate of the fourth switch.

3. The display device according to claim 1, wherein the first and third switches have the same on-off timing, wherein the second and fourth switches have the same on-off timing, and wherein the first and third switches have different on-off timing from the second and fourth switches.

4. The display device according to claim 1, wherein the first control node, the second control node, the third control node, and the fourth control node correspond to the gate node of the first switch, the gate node of the second switch, the gate node of the third switch, and the gate node of the fourth switch, respectively.

5. The display device according to claim 4, wherein a single first control auxiliary signal is applied to the first and third control auxiliary nodes, and wherein a single second control auxiliary signal is applied to the second and fourth control auxiliary nodes.

6. The display device according to claim 4, wherein the first and third capacitors have the same charge and discharge timing, wherein the second and fourth capacitors have the same charge and discharge timing, wherein a discharge of the first and third capacitors is triggered by a charge of the second and fourth capacitors, and wherein a discharge of the second and fourth capacitors is triggered by a charge of the first and third capacitors.

7. The display device according to claim 4, wherein the first charge/discharge control circuit includes:

a first charge controller electrically connected between a first supply node and the first control node to be on-off controlled by the first control signal, a first discharge controller electrically connected between the first supply node and the first control node to be on-off controlled by a first discharge signal, and a first discharge auxiliary controller electrically connected between the first supply node and the first control node to be on-off controlled by a first discharge auxiliary signal, wherein the second charge/discharge control circuit includes:

a second charge controller electrically connected between a second supply node and the second control node to be on-off controlled by the second control signal, a second discharge controller electrically connected between the second supply node and the second control node to be on-off controlled by a second discharge signal, and a second discharge auxiliary controller electrically connected between the second supply node and the second control node to be on-off controlled by a second discharge auxiliary signal, wherein the third charge/discharge control circuit includes:

a third charge controller electrically connected between a third supply node and the third control node to be on-off controlled by the first control signal, a third discharge controller electrically connected between the third supply node and the third control node to be on-off controlled by the first discharge signal, and a third discharge auxiliary controller electrically connected between the third supply node and the third control node to be on-off controlled by the first discharge auxiliary signal, and wherein the fourth charge/discharge control circuit includes:

a fourth charge controller electrically connected between a fourth supply node and the fourth control node to be on-off controlled by the second control signal, a fourth discharge controller electrically connected between the fourth supply node and the fourth control node to be on-off controlled by the second discharge signal, and a fourth discharge auxiliary controller electrically connected between the fourth supply node and the fourth control node to be on-off controlled by the second discharge auxiliary signal.

8. The display device according to claim 7, wherein the single first control signal is applied to both the first and third supply nodes, wherein the single second control signal is applied to both the second and fourth supply nodes, wherein the first discharge signal is same as the second control signal, wherein the first discharge auxiliary signal is same as the second control auxiliary signal, wherein the second discharge signal is same as the first control signal, and wherein the second discharge auxiliary signal is same as the first control auxiliary signal.

9. The display device according to claim 7, wherein a rear portion of a high-level voltage period of the first control signal overlaps a front portion of a high-level voltage period of the first control auxiliary signal, and wherein a rear portion of a high-level voltage period of the second control signal overlaps a front portion of a high-level voltage period of the second control auxiliary signal.

10. The display device according to claim 7, wherein a high-level voltage period of the first control auxiliary signal does not overlap a high-level voltage period of the second control signal, and wherein a high-level voltage period of the second control auxiliary signal does not overlap a high-level voltage period of the first control signal.

11. The display device according to claim 7, wherein a rear portion of a high-level voltage period of the first discharge signal overlaps a front portion of a high-level voltage period of the first discharge auxiliary signal, and wherein a rear portion of a high-level voltage period of the second discharge signal overlaps a front portion of a high-level voltage period of the second discharge auxiliary signal.

12. The display device according to claim 7, wherein, the first and third control nodes equally have one voltage condition from among a first voltage condition having a low-level voltage of the first control signal, a second voltage condition having a high-level voltage of the first control signal, and a third voltage condition boosted from the high-level voltage of the first control signal by a high-level voltage of the first control auxiliary signal, and wherein the second and fourth control nodes equally have one voltage condition from among a first voltage condition having a low-level voltage of the second control signal, a second voltage condition having a high-level voltage of the second control signal, and a third voltage condition boosted from the high-level voltage of the second control signal by a high-level voltage of the second control auxiliary signal.

13. The display device according to claim 1, wherein the first, second, third and fourth switches include oxide transistors.

14. The display device according to claim 1, wherein the display panel includes an active area serving as an image display area and a non-active area at a periphery of the active area, and wherein the demultiplexer circuit is disposed in the non-active area.

15. The display device according to claim 14, wherein the non-active area includes:

a pad area electrically connected to the first and second channels of the data driver; and a link area including first and second data link lines, the first and second data link lines being electrically connected to the first and second channels of the data driver via the pad area, wherein the demultiplexer circuit is configured to:

electrically connect a data line selected from the first and second data lines, disposed in the active area, to the first data link line, and electrically connect a data line selected from the third and fourth data lines, disposed in the active area, to the second data link line.

16. The display device according to claim 1, wherein the data driver is mounted on a circuit film electrically connected to the non-active area of the display panel.

17. A demultiplexer for sequentially outputting a data signal to a plurality of data lines disposed in a display panel, the demultiplexer comprising:

a first switch configured to electrically connect a first channel with a first data line among the plurality of data lines;

a second switch configured to electrically connect the first channel with a second data line among the plurality of data lines;

a third switch configured to electrically connect a second channel with a third data line among the plurality of data lines; and a fourth switch configured to electrically connect the second channel with a fourth data line among the plurality of data lines, wherein a first gate of the first switch and a third gate of the third switch are configured to receive a same single first control signal, wherein a second gate of the second switch and a fourth gate of the fourth switch are configured to receive a same single second control signal, and wherein the demultiplexer further comprises:

a first capacitor electrically connected between a first control auxiliary node and each of the first gate of the first switch and a first charge/discharge control circuit configured to control charge and discharge of the first capacitor;

a second capacitor electrically connected between a second control auxiliary node and each of the second gate of the second switch and a second charge/discharge control circuit configured to control charge and discharge of the second capacitor;

a third capacitor electrically connected between a third control auxiliary node and each of the third gate of the third switch and a third charge/discharge control circuit configured to control charge and discharge of the third capacitor; and a fourth capacitor electrically connected between a fourth control auxiliary node and each of the fourth gate of the fourth switch and a fourth charge/discharge control circuit configured to control charge and discharge of the fourth capacitor.

18. The demultiplexer according to claim 17, wherein the first gate and the third gate are configured to be electrically disconnected from each other at a certain point in time, and wherein the second gate and the fourth gate are configured to be electrically disconnected from each other at a certain point in time.

19. The demultiplexer according to claim 17, wherein the first and third capacitors are configured to receive a same single first control auxiliary signal, and wherein the second and fourth capacitors are configured to receive a same single second control auxiliary signal.

20. A demultiplexer for sequentially outputting a data signal to a plurality of data lines disposed in a display panel, the demultiplexer comprising:

a first switch configured to electrically connect a first channel with a first data line among the plurality of data lines;

a second switch configured to electrically connect the first channel with a second data line among the plurality of data lines;

a third switch configured to electrically connect a second channel with a third data line among the plurality of data lines; and a fourth switch configured to electrically connect the second channel with a fourth data line among the plurality of data lines, wherein a first gate of the first switch and a third gate of the third switch are electrically connected to each other, wherein a second gate of the second switch and a fourth gate of the fourth switch are electrically connected to each other, and wherein the demultiplexer further comprises:

a first capacitor electrically connected between a first control auxiliary node and each of the first gate of the first switch and a first charge/discharge control circuit configured to control charge and discharge of the first capacitor;

a second capacitor electrically connected between a second control auxiliary node and each of the second gate of the second switch and a second charge/discharge control circuit configured to control charge and discharge of the second capacitor;

a third capacitor electrically connected between a third control auxiliary node and each of the third gate of the third switch and a third charge/discharge control circuit configured to control charge and discharge of the third capacitor; and a fourth capacitor electrically connected between a fourth control auxiliary node and each of the fourth gate of the fourth switch and a fourth charge/discharge control circuit configured to control charge and discharge of the fourth capacitor.

* * * * *